United States Patent [19]

Newsome

[11] Patent Number: 4,850,582

[45] Date of Patent: Jul. 25, 1989

[54] TWIST BELT APPARATUS FOR CHANGING POSTURE OF TRANSPORTED DOCUMENTS

[76] Inventor: John R. Newsome, R.R. #1, Box 58A, Shumway, Ill. 62461

[21] Appl. No.: 175,927

[22] Filed: Mar. 31, 1988

Related U.S. Application Data

[62] Division of Ser. No. 882,073, Jul. 3, 1986, Pat. No. 4,747,817.

[51] Int. Cl.[4] ..... B65H 29/12

[52] U.S. Cl. ..... 271/185

[58] Field of Search ..... 271/184–186

[56] References Cited

U.S. PATENT DOCUMENTS

| | | | |
|---|---|---|---|
| 2,841,394 | 7/1958 | Stobb | 271/185 |
| 3,671,035 | 6/1972 | Reist | 271/185 X |
| 3,838,771 | 10/1974 | Whiteford | 271/186 X |
| 4,330,116 | 5/1982 | Newsome | 271/185 X |

*Primary Examiner*—Richard A. Schacher

*Attorney, Agent, or Firm*—Leydig, Voit & Mayer

[57] ABSTRACT

A quarter folder machine for accepting half fold signatures and converting them into quarter signatures. The machine receives half signatures in an incoming shingle running at relatively low velocity, strips and accelerates the signatures to travel seriatim in a high speed stream which passes through camming and crimping means to create the quarter fold. A decelerating and re-shingling section then converts the stream back into an output shingle which runs at relatively low linear velocity but at a high rate in terms of signatures per hour—for transport to some subsequent processing device. The machine is characterized by a very high throughput rate. It is flexibly adjustable to match to the velocity of and setback of an incoming shingle from various sources, and yet to determine by choice the setback and velocity of the output shingle.

8 Claims, 8 Drawing Sheets

Fig. 16.
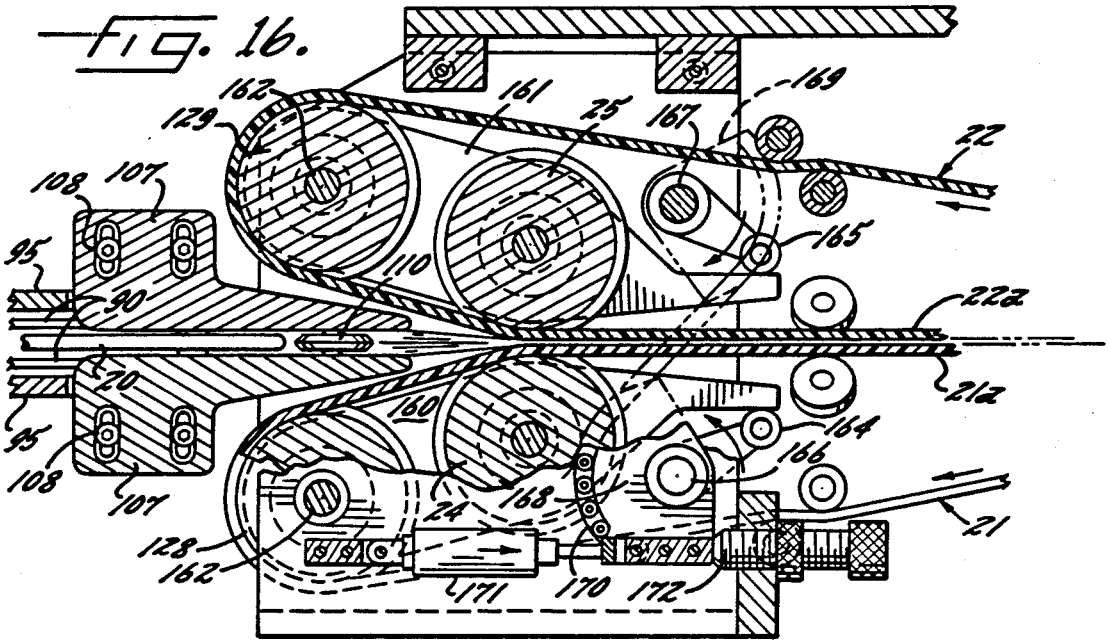
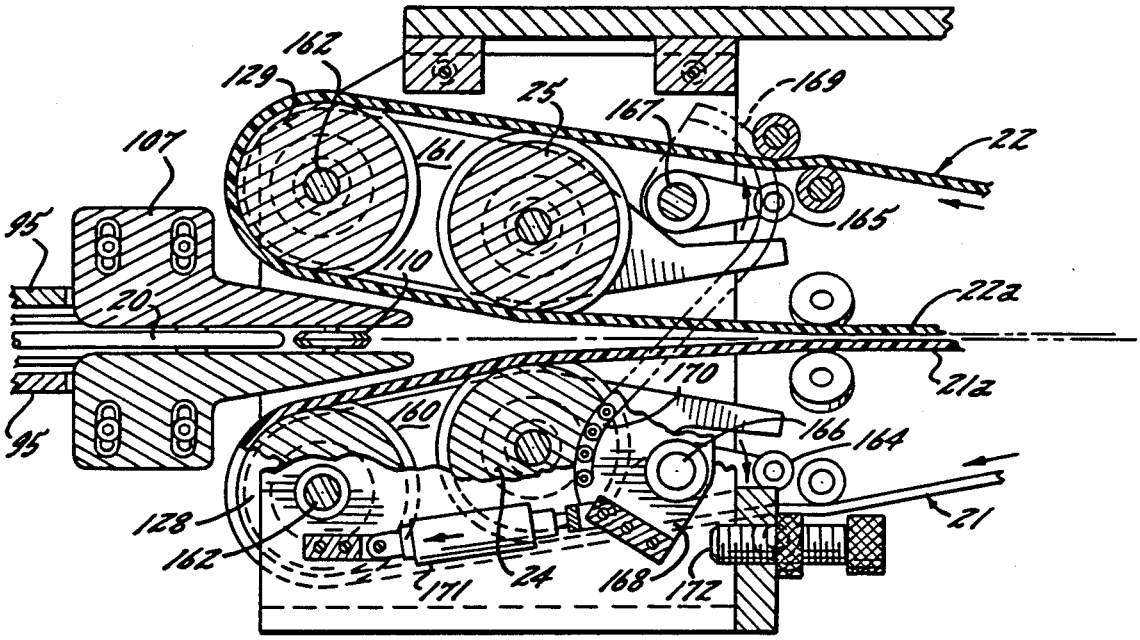
Fig. 17.

TWIST BELT APPARATUS FOR CHANGING POSTURE OF TRANSPORTED DOCUMENTS

This application is a division, lodged under 35 U.S.C. 121, of copending U.S. application Ser. No. 882,073, filed July 3, 1986 in the name of John R. Newsome, now U.S. Pat. No. 4,747,817.

BACKGROUND OF THE INVENTION

The present invention relates in general to apparatus for manipulating paper signatures or objects of like nature. More particularly, the invention pertains to apparatus for performing a given operation upon individual signatures in sequence but with the signatures efficiently brought in and taken out at extremely high rates in terms of signatures per unit time.

Although the invention in certain aspects is not so limited, it is aimed toward achieving, and is embodied in, a high speed quarter folder. As is known in the printing art, newspaper presses conventionally include folding and transport units which bring out multiple sheet, single folded assemblies in an overlapped running shingle. The assemblies are called "signatures" and their folded edges are called "spines". The signatures in a running shingle usually move with the spines as leading edges and with each signature set back slightly (here called the shingle setback SSB) from the one which precedes it so that they travel in overlapped relation. A single fold signature may sometimes be called a "half signature"; when it is folded again about a medial line perpendicular to its spine, it becomes a quarter signature. By cutting at the original spine edge, a quarter signature may be turned into a booklet wherein each page is one quarter of an original sheet of paper. A quarter folder makes the second fold in a half signature to convert it into a quarter signature.

Almost universally, half fold signatures exit from a printing press, or they come from any other source, as a running shingle—for the reasons that the shingle is less flexible than individual signatures, and a high rate of through-put in items per unit time (e.g., signatures per hour) can be obtained with a lower conveyor speed in comparison to transporting signatures spaced out to travel one at a time.

When a given operation, such as quarter folding, must and can only be performed on signatures one at a time, however, then a spaced-out stream of successive signatures is required. And the conversion of a shingle to a stream has heretofore been a limiting factor on the through-put rate —to such an extent that quarter folders and similar devices could not keep up with, and could not directly accept the running shingle output of, a high speed press or other high rate source of half signatures. Indeed, this limitation has resulted in a common practice of stacking half signatures coming from a printing press, storing them, and subsequently feeding them into a slower speed quarter folder or similar "one at a time" machine.

OBJECTS AND ADVANTAGES OF THE INVENTION

It is the primary aim of the invention to provide a quarter folder machine, or one of similar nature that performs a given operation sequentially on successive signatures, which acts with an extremely high through-put rate compared to known, prior machines. For example, one embodiment of the present invention operates to produce quarter folding at a rate on the order of 72,000 signatures per hour; whereas, to the extent of applicant's knowledge, prior quarter folders could run at about 30,000 to 35,000 signatures per hour as a maximum.

Another object is to bring to the art a functionally successful quarter folder machine, or a machine of similar nature, which may directly accept the running shingle of half signatures outputted from a source (e.g., a printing press) at a high rate of signatures per hour.

A further objective of the invention is to provide a quarter folder machine which accepts as its input a running shingle of half signatures and produces as its output a second running shingle of quarter signatures, both shingles having a high and essentially equal rate of signatures per hour but transported by conveyor means moving at reasonably low velocities in comparison to the velocity that would be required for transport of spaced, individual signatures at such rate.

It is still another object to provide a machine which performs a given operation (e.g., folding) on successive individual signatures by accelerating successive signatures, as they are received in a first shingle running at a first velocity, to a substantially higher speed so that they travel as a stream of separated items; to perform said operation on each item as it is conveyed at that speed; and then to decelerate the items and form them into a second shingle running at a second velocity —and with high through-put rates.

A related object is to assure that in such a machine, the rates of through-put (signatures per hour) are made essentially equal for both the first and second shingles, thereby to avoid pile-up or running dry at the second shingle.

Another related object is to provide such a machine in which the setback $SSB_2$ for the second shingle may be chosen and determined relative to the setback $SSB_1$ of the first shingle, the two setbacks not necessarily being equal. Indeed, it is an object to make the second setback $SSB_2$ unequal to the first setback $SSB_1$ and advantageously smaller.

It is also an object t o provide, as a subcombination of general utility, apparatus for converting a high speed stream of spaced signatures into a shingle which runs at a much lower linear velocity, for example, as low as one-eighth or one-tenth the speed of the stream. A related feature of such apparatus is a unique and very simple arrangement for dissipating kinetic energy of individual high speed signatures as they are slowed down to a much lower velocity in a shingle.

Additional objects and advantages reside in a simple, novel transport and camming arrangement to create a fold (e.g., a quarter fold) in passing horizontal signatures. Unlike a chopping folder, it requires no moving parts other than the conveyor elements which transport the signatures along their path of travel.

A further object is to obtain dual functions from a set of conveyor belts —namely, the final crimping of a fold (e.g., a quarter fold) along the upper spine of a signature traveling in vertical orientation, and the rocking of that signature essentially about the spine and upwardly to horizontal orientation —as it continues traveling along the path.

Brief Description of the Drawings

Other objects and advantages will become apparent as the following description proceeds in conjunction with the accompanying drawings, in which:

FIGS. 16 and 17 are fragmentary horizontal sectional views taken substantially along the line 16—16 in FIG. 15 and showing an adjustable nip throat respectively its closed and opened conditions;

While the invention has been shown and will be described in some detail with reference to one preferred embodiment as an example, there is no intention thus to limit the invention to such detail. On the contrary, it is intended here to cover all modifications, alternatives and equivalents which fall within the spirit and scope of the invention as defined by the appended claims. Moreover, while the invention will be described with reference to the manipulation of and the performance of operations on newsprint signatures (which come in as half-fold signatures and leave as quarter-fold signatures), it is to be understood that the invention may find advantageous application in the manipulation or processing of objects or items which are similar in nature to such signatures. It will be readily apparent that an unfolded assembly of sheets, or a thick single sheet of cardboard or the like, might be the item or object fed in and that the operation performed on it might produce a single fold rather the second or double fold which characterizes quarter signatures.

DETAILED DESCRIPTION OF THE PREFERRED EMBODIMENT

1. Introduction and Overview

Figures 1, 2, 5, 6:
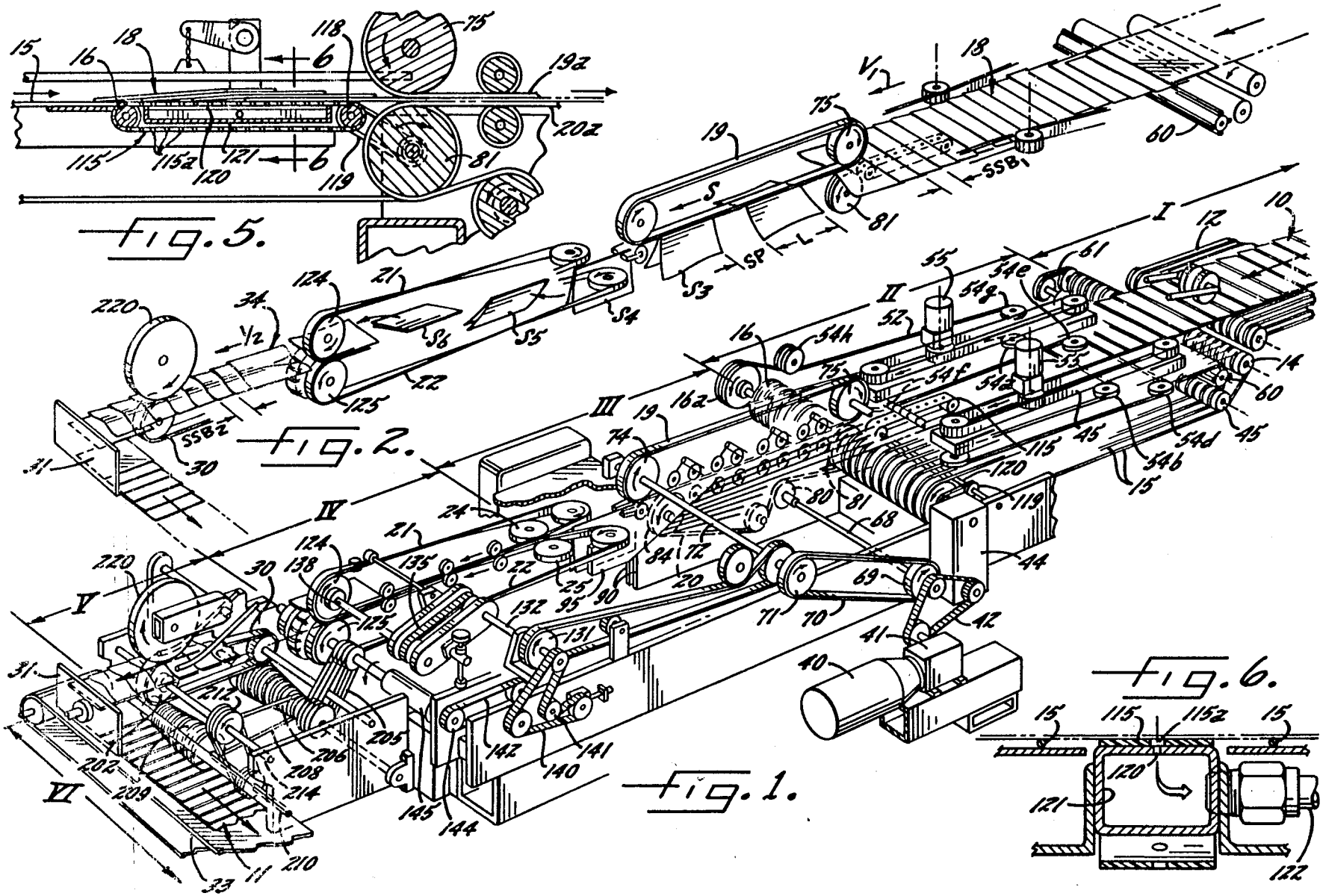
FIG. 1 is a diagrammatic, perspective illustration of an entire machine (here, a quarter folder) for performing a given operation on successive signatures which arrive as an incoming shingle and depart as an exiting shingle —such machine embodying the features of the present invention.
FIG. 2 is a fragmentary representation of that machine with emphasis upon the functions performed in the successive sections of the machine, particularly illustrating the action upon and the orientation of signatures as,.,they progress from section-to-section.
FIG. 5 is a fragmentary vertical section taken substantially along the line 5—5 in FIG. 3 and showing details of means for inhibiting the cocking of documents as they are grabbed and accelerated.
FIG. 6 is a transverse vertical section taken substantially, along the line 6—6 in FIG. 5.

FIG. 1 shows the general organization of what may be characterized as a quarter folding machine which receives half folded newsprint signatures as an incoming shingle 10, which produces a quarter fold in such signatures, and which conveys them such that they exit as an outgoing shingle 11. Generally speaking, the signatures proceed along a flow path from right to left as viewed in FIG. 1 to progress through successive sections of the machine which will be generally designated here and then each described in greater detail below. FIG. 2 is a functional illustration which aids in understanding the operation performed upon, the orientation of, each successive signature as it progresses along and through the flow path, the tandem sections in FIG. 2 corresponding to those designated by Roman numerals in FIG. 1.

Section I at the right is not, strictly speaking, a part of the machine here to be described. Rather, section I represents any suitable apparatus which constitutes a source of signatures which feeds in, by any suitable conveyor, a running shingle of overlapped signatures. The source may include a plurality of conveyor belts 12 appropriately driven in a downstream direction to carry the shingle 10 inwardly. Thus, section I may be constituted by a in-feeder apparatus of the sort described and claimed in applicant's copending application Ser. No. 06/880,131 filed June 30, 1986; alternatively, the source of documents in the form of a running shingle 10 may be constituted by the output of a printing press, if indeed the printing press is sufficiently accurate in its organization and operation as to output a shingle with a reasonably uniform setback between adjacent ones of the overlapped signatures. In any event, the signatures arrive at the upstream sheave 14 of a conveyor which is included in section II, such conveyor being here shown as constituted by a plurality of resilient, circular cross-section belts 15 having their upper flights driven to run in a downstream direction.

Figures 3, 4:
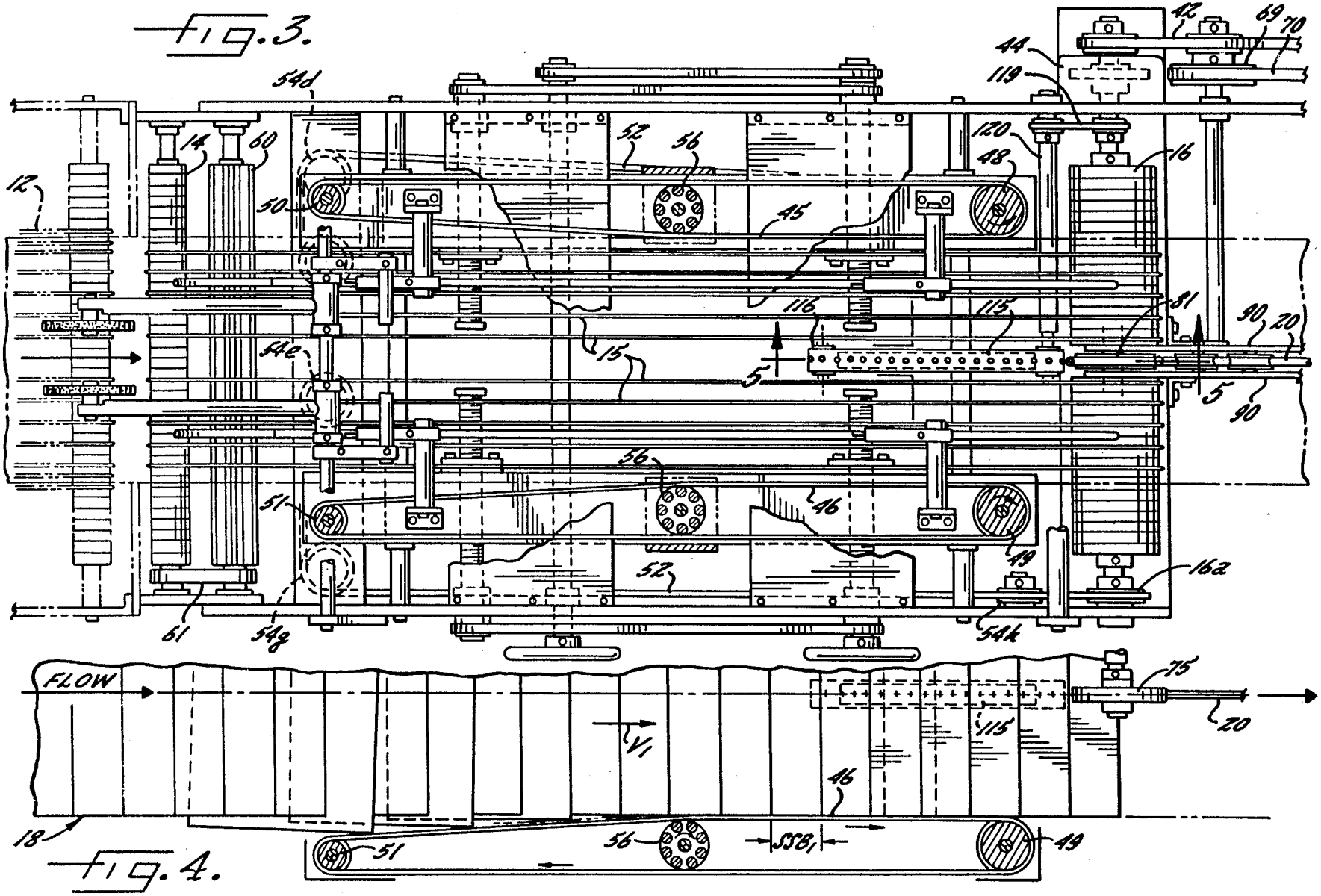
FIG. 3 is a plan view of the signature-aligning section of the machine.
FIG. 4 is a fragmentary view, corresponding diagrammatically to a portion of FIG. 3 and illustrating the manner in which misaligned signatures in the incoming shingle are jogged into alignment.
Figure 7:
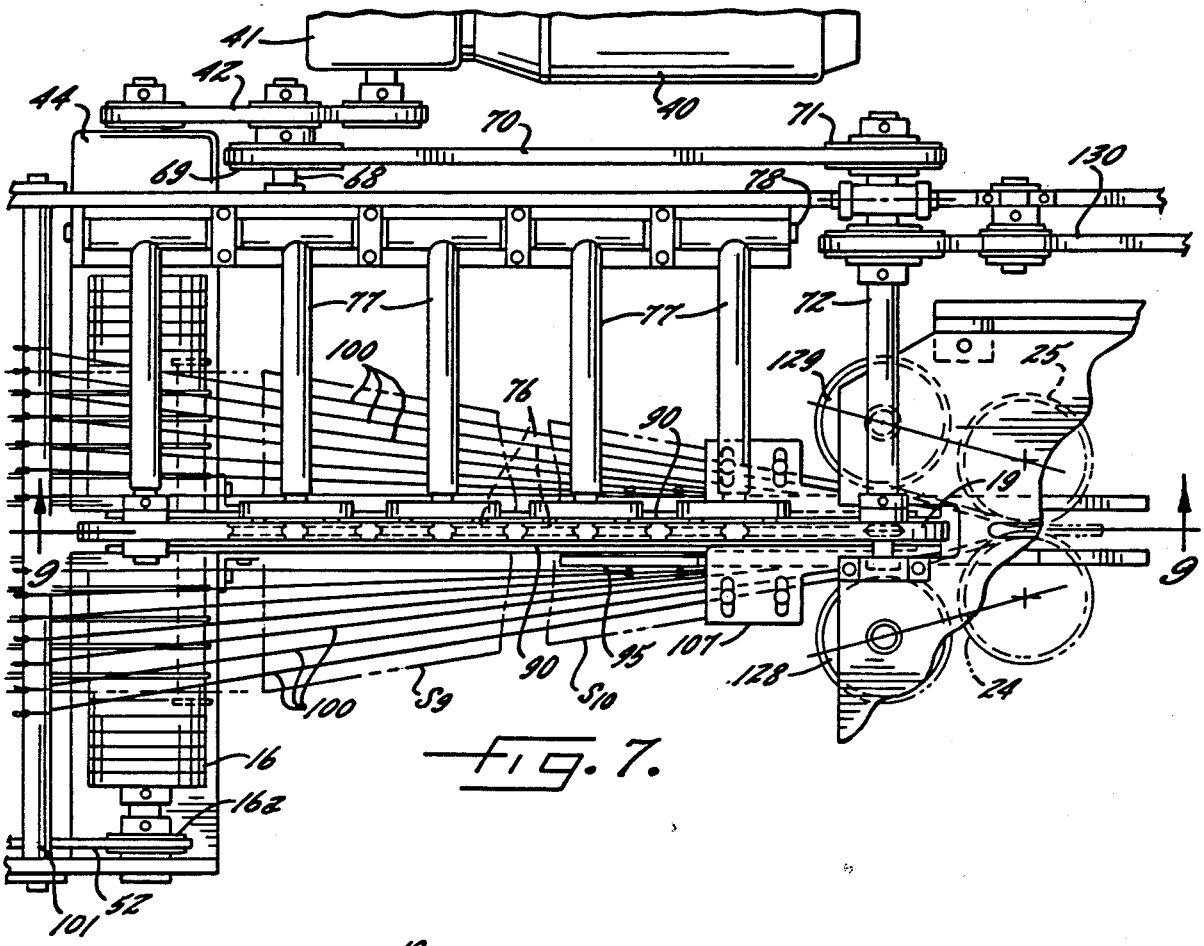
FIG. 7 is a plan view corresponding to a portion of FIG. 1 and showing in greater detail the stripping, accelerating ,and folding section of the machine.

As the signatures arrive from the in-feed source of section I, they may be somewhat misaligned or skewed in a transverse direction (see FIG. 4). Section II of the machine constitutes an alignment means which "squares up" the individual signatures so that their side edges are all coincident and essentially parallel to the center line of the downstream flow path. In the event that the in-feed source of section I is able to supply a running shingle with its signatures accurately aligned in a transverse direction, then the alignment apparatus in section II might advantageously be omitted from the machine which is to be described. In general terms, the alignment apparatus in FIG. 1 makes certain that the longitudinal center line of each signature in the running shingle, as it reaches the output sheave 16 for the conveyor belts 15, is coincident with and parallel to the longitudinal center line of the flow path in which the conveyor belts 15 are moving. In any event, and as labeled in FIG. 2, the signatures exiting from the alignment section II are in the form of a running shingle 18 having a setback $SSB_l$ between the leading edges of adjacent signatures and traveling at some selected linear velocity here designated $V_1$.

As the signatures in the shingle 18 exit from section II, they enter a stripping, accelerating and folding section III for continued transport by upper and lower driven conveyor belts 19 and 20. The lower flight of the belt 19 is juxtaposed to and disposed in closely spaced relation to the upper flight of the belt 20 —and such belts are driven at a markedly higher linear speed S than the velocity $V_1$ of the shingle 18. Pulleys at the downstream ends of the belts 19, 20 are arranged to make those belts define a nip throat which grabs the leading edge of each signature in the shingle 18, thereby accelerating and stripping that signature away from the shingle so that it runs individually at a higher speed, and with spacing between the preceding and succeeding shingles while gripped between the opposed flights of the two belts 19, 20. The belts 19, 20 are relatively narrow in transverse width, and they engage each half signature substantially along only the transverse center line as it is carried downstream along its flow path. Each half signature as it is first transported by the belts 19, 20 lies generally in a horizontal plane (see FIG. 2) with its lateral extremities (sometimes herein called "wings") extending laterally outwardly on either side of those belts. As will be explained in greater detail below, section III of the machine includes camming means to urge those lateral wings downwardly into a bight about and relative to the underlying flight of the lower belt 20 so that by the time that individual signature reaches the downstream end of the conveyor belt 19, it will have a substantially vertical orientation and a general quarter-folded configuration. The belts 19, 20 propel each signature between vertically disposed and juxtaposed faces of two additional conveyor belts 21, 22 at a nip throat defined by horizontally-oriented pulleys 24, 25 —so that the uppermost bight of an entering signature is not only received between and transported with the belts 21, 22 but is also creased or crimped to establish a final quarter fold. Therefore, a quarter fold signature with vertical orientation exits downstream from between the pulleys 24 and 25, which lie in horizontal planes. The signature is still traveling at the speed S by virtue of the fact that the belts 21, 22 are driven at the same linear speed as the belts 19, 20 and the individual signatures are still traveling in a stream spaced apart from one another.

The belts 21 and 22 serve a dual function. They form a crimping nip which establishes the final quarter fold crease in each signature as the latter moves between the pulleys 24 and 25 in a vertically disposed orientation. The belts 21, 22 serve a second, important function in section IV of the machine, namely, to rock each vertically oriented signature upwardly about its quarter-fold spine as an axis so that it is again horizontally oriented. For this purpose, the belts 21, 22 are trained about idler and drive pulleys such that their opposed flights progressively execute a 90-degree twist. By the time a signature has reached the downstream ends of the belts 21 and 22 where they run over downstream pulleys, the opposed belt faces are horizontally disposed, and each signature, gripped along its right edge or quarter spine exits in a downstream direction into section V. Each successive individual signature thus exits from section IV at the speed or velocity S and is decelerated and reshingled by the apparatus in section V.

Specifically, the slow-down and re-shingle section V includes means to define a moving throat into which the leading edge of each successive shingle is hurled. By means to be described more fully below, that throat includes means to decelerate each signature so that it falls downwardly onto the top of a preceding signature moving with a more slowly driven, underlying conveyor belt 30 traveling at a velocity $V_2$ which is substantially less than the speed S. Thus, an output shingle of quarter-folded signatures is created on the belt 30 traveling at the speed $V_2$ (which may, for example, be on the order of one-eighth of the speed S) as seen generally in FIG. 19.

From the conveyor within the section V, the running shingle is ejected into a "bump and turn" section VI of known organization. The leading edge of each signature strikes a vertical bump plate 31 and that signature then falls downwardly in time-staggered relation to the preceding signature onto a conveyor 33 traveling in a direction at 90-degrees to the original flow path. The bump and turn section VI is of known organization and it is an optional part of the present machine. It results in the final or departing shingle 11 of quarter-folded signatures running with their quarter-fold spines leading, and by the exiting conveyor 33 the signatures may be transported to any final processing device such as a trimmer, a stacker, or some other machine. In some applications, the shingle as it exits from the conveyor belt 30 of section V may be fed directly to a further processing device.

From a purely manipulative or functional viewpoint, it may be noted from FIG. 2 that horizontally oriented half-signatures $s_1$ arrive from section II in the shingle 18 and enter section III with that horizontal orientation but gripped only along their longitudinal center lines corresponding to the center line of the flow path. In section III, the lateral wings of a generally horizontal signature $s_2$ are bent and cammed downwardly to a generally vertical orientation as illustrated by the signatures $s_3$ and $s_4$. With that orientation and the upper bight of the signatures embracing the lower belt 20, the signatures are transported through the nip rollers 24, 25 so that the bight is crimped into a creased spine of a quarterfolded signature. The belts 21, 22 in section IV continue to transport the signatures in a spaced apart stream at the speed S and act further to swing each signature progressively (see $s_5$ and $s_6$) upwardly about its spine as an axis until it passes through the exiting pulleys for those belts in horizontal orientation (see the signature $s_7$).

The signatures then enter the deceleration and reshingling section V where each individual signature is slowed down and deposited in overlapped relation upon the preceding signature to form a running shingle 34 traveling at a lower velocity $V_2$ which is less than the velocity S by a selected fraction or slow-down ratio. The signatures traveling at that lower velocity $V_2$ in the output shingle 34 may then be sent to any other processing unit; they are here shown by way of example as fed through a bump and turn section VI from which they exit as a shingle 11 running at 90 degrees to the original path and with the quarter-fold spines as leading edges.

In FIGS. 1 and 2, the travel or flow path for the shingles, as they come in and progress to the exit section V, has been shown leading from right to left. In the remaining figures of the drawings, however, the flow path or travel proceeds from left to right, so the reader should understand that such remaining FIGS. 3–23 are drawn as if the viewer were standing on the far side of the machine as it appears in FIG. 1. In the more detailed description which follows, the terms "left" and "right" will be employed as if one were looking in a downstream direction along the flow path; the term "longitudinal" will be employed as designating a direction along or parallel to the flow path; and the term "lateral" will be employed as meaning a direction which is transverse or at right angles to the flow path.

2. The Alignment Section In More Detail

Referring first to FIG. 1, a single, variable speed drive motor 40 serves as the mechanical drive source for all of the machine sections II, III, IV, V. The speed of the motor may be adjusted by a human operator via speed control means (not shown); its output is taken through a reducing gear box 41 to a toothed drive belt 42 and thence to the input of an adjustable ratio gear unit 44 having its output shaft directly connected to drive the grooved sheave 16 which, in turn, drives the laterally-spaced conveyor belts 15 in a closed path. By adjusting the ratio of the gear box 44, the speed of the conveyor belts 15 in relation to the speed of the belts 19, 20 may be changed so as to change the ratio between the velocity $V_1$ and the higher velocity S at which signatures are transported in a spaced stream. From FIG. 1, it may be seen that the belts, 15 are trained over an idler sheave 45 and the upstream pulley 14 as an idler, the shingle 18 (FIG. 2) thus being transported on the upper flights of the belts 15 at a desired speed $V_1$.

As the signatures enter the alignment section II with their transverse edges laterally misaligned or skewed (see FIG. 4), they travel down the flow path in FIG. 3 between jogging or beating flat belts 45 and 46 which are vertically disposed on either side of the flow path. These vertically disposed side belts are somewhat resilient in nature; they are trained over driving pulleys 48 and 49 at their respective downstream ends and upstream idler pulleys 50, 51 so that the innermost flights of those vertical belts (i.e., the flights adjacent the flow path) define a guiding channel into which the traveling shingle is carried by the underlying conveyor belts 15. Input drive to the pulleys 48 and 49 is provided by a single, long, resilient belt 52 of circular cross section. This latter belt is trained over an end portion 16*a* of the driven sheave 16 and runs hence over spaced pulleys 54*a* through 54*h*. The pulleys 54*c* and 54*f* are disposed beneath and on the same shafts for the drive pulleys 49 and 48 (FIG. 3) so that the inner flights of the two vertical belts 45 and 46 are driven in a downstream direction.

To bring the signatures of an incoming shingle into lateral alignment, the inner flights of the belts 45 and 46 are vibrated or "beated" in a transverse direction. As here shown, two continuously-running electric motors 55 are appropriately mounted on vertical axes and arranged to drive beater wheels 56 (FIG. 3) disposed transversely outboard of and in contact with the inner flights of the belts 45 and 46. The wheels 56, in effect, carry a plurality of peripherally spaced rollers so that they vary in effective diameter from point-to-point along their peripheries. As the wheels 56 rotate, therefore, they stretch and "beat" the belts 45 in a vibratory fashion so that the belts rapidly change from a configuration such that the downstream flights from the beater wheels are parallel to the flow path (as shown in FIG. 3) to a configuration in which the downstream portions of the flights of belts 45 and 46 are angularly inclined to, and form a converging channel relative to, the flow path. This arrangement for providing vibrating belts along the sides of a traveling shingle to jog and align individual signatures is per se known; it is disclosed and claimed in applicant's U.S. Pat. No. 4,381,108 issued on Apr. 26, 1983. Therefore, no further detailed description of the beating apparatus and the alignment action need be set forth here. It will be seen from FIG. 3, however, that the incoming shingle 18 exits from the alignment section when the signatures within that shingle reach and proceed beyond the downstream drive sheave 16 which carries the laterally spaced conveyor belts 15 traveling at the velocity $V_1$.

In the earlier U.S. Pat. No. 4,381,108, the vibration of belts to facilitate alignment of signatures was applied only to vertically upstanding belts creating side guides acting on the lateral edges of the traveling signatures. As an improvement in the present machine, means are provided to vibrate the underlying conveyor belts 15 so that friction between the belts themselves and the signatures of the supported shingle, and friction between adjacent signatures within that shingle, is lessened and the transverse adjustment of signature positions to align their lateral edges is enhanced. As here shown in FIGS. 1 and 3, a bottom-beater roll 60 is disposed beneath the upper flight of the belts 15 and in contact therewith. The pulley 60 is formed with a non-uniform peripheral surface so that as each of the "high points" on its periphery strikes the belts 15 the latter are lifted slightly and thus vibrated. The bottom beater roll 60 is driven from the idler pulley 14 (which is driven by the belts 15) via a belt 61 visible in FIGS. 1 and 3. Since the conveyor belts 15 are stretched and resilient, this beating action, which raises and lowers their upper flight at high frequency throughout substantially the entire upper flight length, enhances the ease with which misaligned signatures may be shifted into aligned relation through the action of the vibrating side belts 45 and 46.

Again, it may be noted that if the in-fed shingle 10 (FIG. 1) arrives not only with substantially uniform shingle setback but also good lateral alignment of its individual signatures, then the alignment section II may be omitted from the machine and the shingle 10 may be fed directly to section III.

3. The Strip, Accelerate and Fold Section in Greater Detail

As noted in a general sense above, the stripping and acceleration section III includes the upper and lower belts 19 and 20 driven at a relatively high speed S with their respective lower and upper flights (labeled 19*a*, 20*a* in FIGS. 9, 11 and 12) in closely spaced, superimposed relation along the centerline of the travel path. The manner in which these two belts are driven may best be seen in FIG. 1 where the toothed belt 42 drives a shaft 68 carrying a pulley 69 over which still another belt 70 is trained to drive a pulley 71 fixed on a shaft 72. The shaft 72 carries a pulley 74 disposed at the middle of the machine; the pulley 74 carries the downstream end of the belt 19 thereby driving the latter belt with its lower flight moving downstream along the path, the upstream end of the belt 9 being trained over a locating and idler pulley 75. As shown best in FIG. 9, a plurality of idler pulleys 76 are disposed just above the lower flight 19*a* so as to hold the latter firmly and make it run in a horizontal direction downstream. The idlers 75 are carried in pairs at the inner ends of support arms 77 which may be swung upwardly about a longitudinal mounting rod 78 when it is desired to service the machine or possibly to clear away any jammed signatures.

Figure 11:
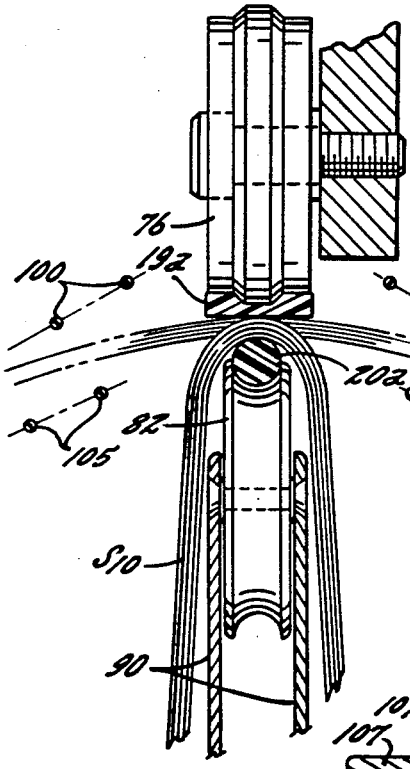
FIGS. 11, 12 and 13 are transverse vertical sections taken substantially along the lines 11—11, 12—12 and 13—13 in FIG. 8 to illustrate certain details of the apparatus by which a half-fold signature is manipulated to produce a quarter fold therein.
Figure 12:
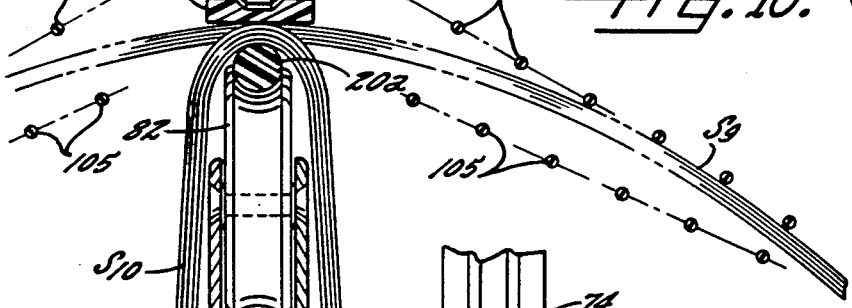
Figure 12:
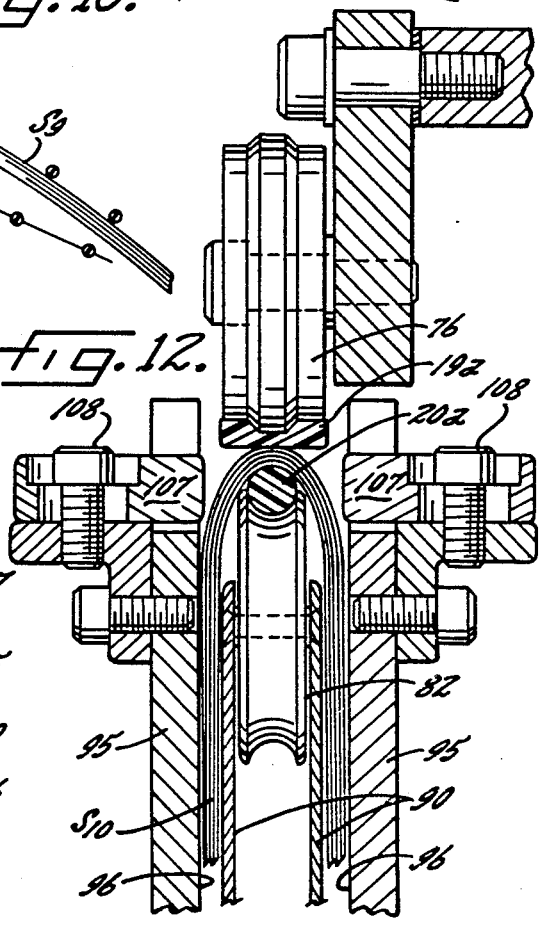

For the drive of the lower belt 20, the shaft 68 in FIG. 1 carries at its inboard end a pulley 80 over which the round cross section belt 20 is trained. That round belt 20 proceeds over an upstream pulley 81 (journaled on a medial shaft portion of the sheave 16) and thence along the upper surfaces of support idlers 82 (FIG. 9) to the downstream pulley 84, and returns via an idler 85 to the drive pulley 80. The pulleys 81, 82, 84 and 85 are journaled on stub shafts supported by and between two mounting plates spaced apart laterally from the path centerline (FIGS. 11 and 12). The mounting plates may be appropriately connected to and held on a part of the machine frame (not shown) at their lower edges. It will thus now be seen how the belts 19 and 20 are both driven at the same speed so that their vertically superimposed and opposed flights 19*a*, 20*a* run in a downstream direction at a selected speed S. The ratio between the velocity $V_1$ and the speed S may be adjusted by an operator changing the setting of the variable gear drive 44.

Figure 9:
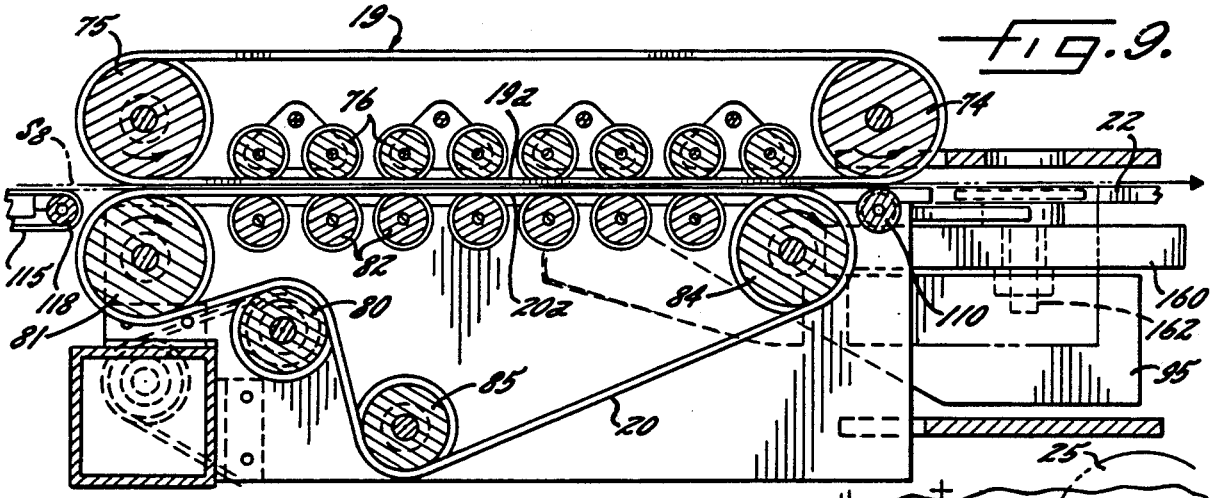
FIG. 9 is a longitudinal vertical section taken substantially, long the line 9—9 in FIG. 7.

As shown at the left in FIG. 9, an incoming signature $s_8$ in the shingle leaving the alignment section II has its leading edge projected between the pulleys 75 and 81 where it is grabbed and nipped by the belt flights 19*a* and 20*a*. Thus, that signature is pulled between the belt flights 19*a* and 20*a* and transported therewith in a generally horizontal orientation. As an incident to such grabbing at the nip location between pulleys 75 and 81, that signature is greatly accelerated and thus pulled out or stripped away from the aligned shingle 18 of section II. In consequence, individual signatures travel spaced from one another (by the distance SP, FIG. 2) along the path in a stream with the belt flights 19*a*, 20*a*. Although the belts 19, 20 both participate in transporting the signatures, the belt 20 may be viewed as the primary transport element and the belt 19 may be viewed as a hold-down means. The individual signatures are stripped apart and transported individually in sequence in order that a given operation, which can be performed only individual signatures, is effected on each signature while it is being transported at the velocity S. In the present instance, that given operation is the downward folding of the signature wings so as to create a quarter fold.

In accordance with an important aspect of the present invention, the quarter fold is created in each signature by camming and pressing means which involve no separately moving or reciprocating or oscillating parts. Indeed, tee quarter folding operation is executed by camming the lateral portions or wings of a traveling signature downwardly about the underlying belt flight 20*a* as a mandrel with the overlying belt flight 19*a* serving as a positive retainer holding the centerline of the half signature firmly against the underlying belt flight.

To facilitate this action, the lower belt 20 is preferably made round in cross section, and the upper retaining belt 20 is preferably made with a flat outer surface as will be apparent from FIGS. 11 and 12.

In accomplishing the foregoing, two vertical channels are defined on either side of the path centerline to receive and hold the depending wings of a half signature in a downwardly depending configuration. As here illustrated, along and beneath the downstream portion of the lower belt 20, two channel plates 95 are mounted outboard of the plates 90 to define therewith two vertical channels 96. These channel plates 95 have their upstream edges tapered downwardly in a downstream direction (FIG. 8) so that the channels 96 are deeper beneath the belt flight 20*a* as the distance downstream from the pulleys 75, 81 increases. As a camming means which progressively bends the lateral wings of a traveling signature downwardly so that their leading edges enter the channel 96, means are provided —on each side of the path centerline— to define the equivalent of a twisted surface having (i) its upstream edge disposed essentially horizontally, and (ii) its downstream edge (terminating at the entrance to the channels 96) disposed essentially vertically. While such a twisted surface might possibly be provided by a stretched-formed aluminum sheet, that twisted surface is, in effect, here created by a plurality of spaced nylon cords 100 (FIG. 8) stretched between an upstream anchor rod 101 and downstream locations at the inclined edge of the channel plates 95. At their upstream ends, the nylon cords 100 are spaced apart horizontal along the rod 101 (FIG. 7) and they overlie the nip between the pulleys 75 and 81. Thus, as each individual signature is stripped and accelerated by the belts 19 and 20 while residing essentially in a horizontal orientation, further progressive motion downstream results in the lateral wings of that signature riding in engagement with the twisted surface defined by the nylon cords 100. This produces a camming action which progressively bends down the lateral wings of a traveling signature (see signatures $s_9$ and $s_{10}$ in FIGS. 7 and 8), such that by the time that signature reaches the entrance to the channels 96, those wings are essentially in a vertical configuration and they proceed into and through the channel 96 under the driving action of the belt flights 19*a*, 20*a*. By the time a signature $s_{10}$ has reached the downstream position of the section line 12—12 in FIG. 8, and as illustrated in FIG. 12, its originally-horizontal wings have been cammed into the vertical position and are moving downstream through the channels 96 defined by the mounting plates 90 and the outboard channel plates 95. The upper belt flight 19*a* has held the centerline of the signature firmly against the belt flight 20*a* so that the signature is stabilized and cannot shift due to forces of the camming action. The signature is in the configuration of a downwardly open bight with the rib of the bight riding on the belt flight 20*a*.

Figure 8:
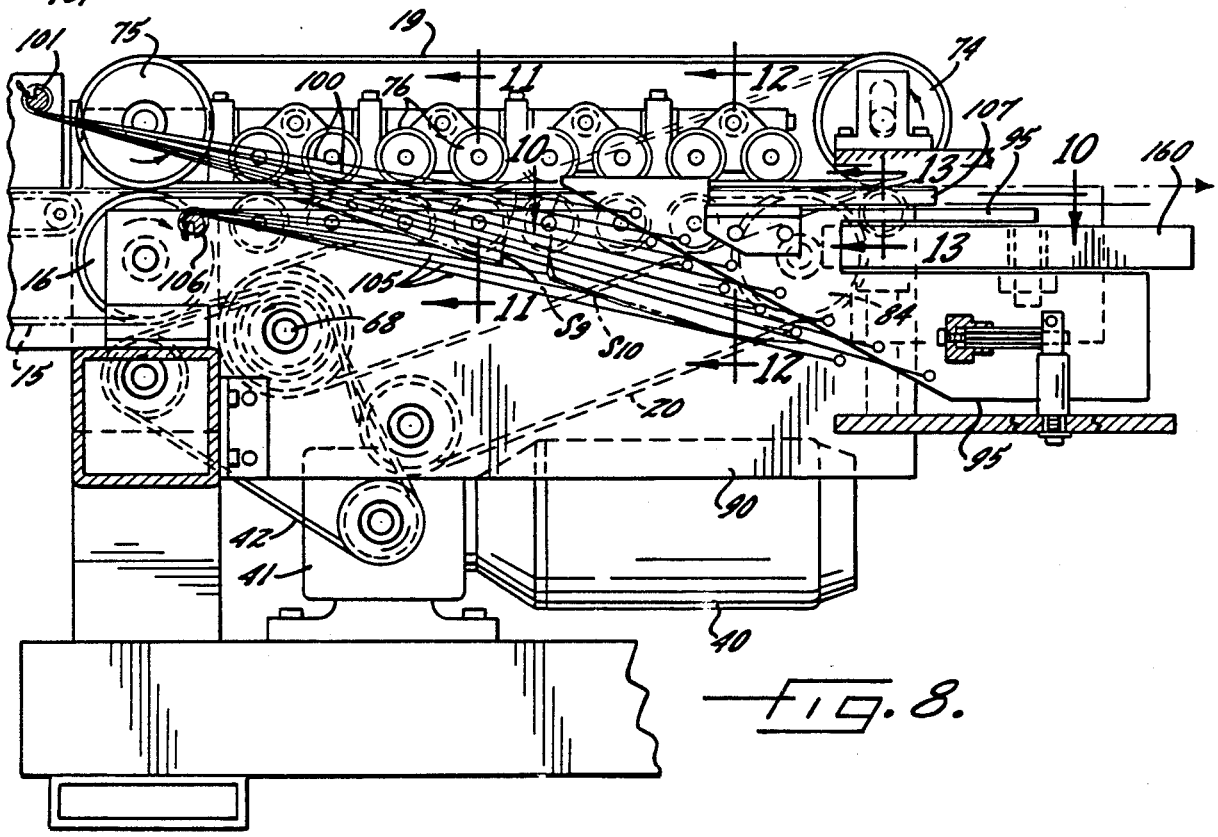
FIG. 8 is a fragmentary side elevation of the apparatus which is shown in plan view by FIG. 7.

In accordance with an optional aspect of this camming arrangement, means are provided, in effect, to create a second twisted surface which underlies the first and defines therewith a twisted corridor which confines the signature wings as they proceed downstream and are cammed to a vertical orientation. As shown in FIGS. 8 and 11, a second set of spaced nylon cords 105 extends from a horizontal anchor rod 106 to vertically spaced anchor points on the mounting plates 90 just upsteam from the inclined edge of the channel plates 95. This underlying twisted surface performs no downward camming action but it serves to prevent "flutter" or undue downward drooping of the signature wings due to air dynamics as that signature is traveling at extremely high speed.

It will thus be understood that the present invention in one of its features contemplates a twisted surface which will contact and cam the horizontal outboard wings of a traveling signature (carried almost solely along its centerline by means such as the belts 19 and 20) so that the two outboard wings of the signature are deformed downwardly into a vertical orientation where they enter a confining channel 96 as their downstream motion continues. It may be preferred in some instances to round or bevel the upstream edges of the channel plates 95 (see FIG. 10) to create additional camming that makes the essentially vertically depending wings of a signature smoothly enter into the channel 96 and progress downstream within that channel. This camming action is the first of multiple steps which create the final crimped quarter fold.

Preferably but optionally, stabilizing retainers are associated with the upper portion of the channels 96 to assure that the passing signature does not accidentally depart from the desired bight shape. As shown in FIGS. 7, 10, 12 and 13, two elongated retainers 107 are mounted, with freedom for final adjustment, by bolts 108 at the top of the channel plates 96 and in straddling relation to the flow centerline. These retainers do not actually have rubbing contact with a passing signature, but their vertical side walls 107*a* form an upward and slightly narrower extension of the channels 96. The inboard, upstream corners of the retainers are rounded or beveled (FIGS. 10 and 16) so as to guide any misaligned signature bight in between the side surfaces 107*a*. The downstream tips of the retainers are skewed slightly inwardly so that the side walls converge somewhat in a downstream direction. Thus, the upper bight portion of a passing signature is constrained against lateral wandering, and gusseting of the signatures is prevented.

In accordance with a further advantageous but optional feature, means are provided to produce a scoring or score line along the centerline of the original half signature, thereby to assure that final crimping will result in a straight fold with uniform and equal halves about the quarter fold spine. The score line, in effect, creates a straight "pre-crease" and results in the final crimping producing a fold which follows that crease.

Figure 10:
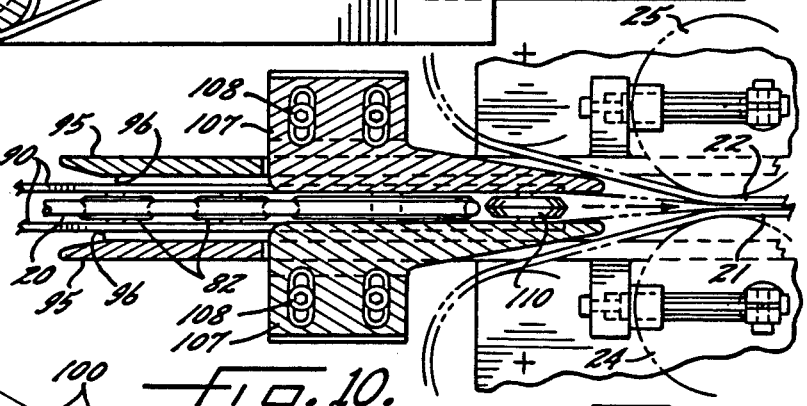
FIG. 10 is a detailed horizontal section view taken substantially along the line 10—10 in FIG. 8.
Figure 13:
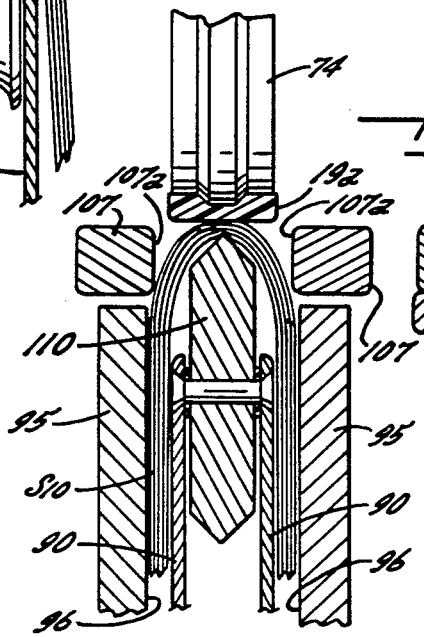

As best seen in FIGS. 9, 10 and 13, the scoring means here take the form of a scoring wheel 110 mounted as an idler between the plates 90 at a location downstream of the pulley 84 and immediately beneath the pulley 74. As a traveling signature in bight shape leaves the downstream end of the belt 20, it proceeds over the wedge-shaped or knife edge of the scoring roller 110 and is pressed against such edge by the flat surface of the belt flight 19*a* traveling under the pulley 74. This produces a score line in the bight of the traveling signature and one which is accurately aligned and coincident with the centerline of the original half signature.

To finish and complete a final and reasonably sharp fold constituting the quarter fold of the signature being acted upon, means are provided to grip that bight edge with firm pressure. In the present instance, this is accomplished by the nip pulleys 24 and 25 (see FIGS. 7 and 10) which lie just downstream from the point at which signatures exit from between the belts 19, 20 and from the scoring wheel 110. As indicated earlier, the nip pulleys 24 and 25 have the belts 21 and 22 running over them with vertically disposed flat faces which would, absent a signature, contact one another. The belts 21, 22 are made of a resilient, compressible material and thus may yield at the nip so a signature bight enters between them and is thus gripped with considerable pressure. As the upper bight edge of a signature moves into the throat defined by those belts, it is progressively compressed and crimped into a crisp fold which completes the quarter signature. This action is particularly illustrated by FIG. 10 where the final crimping action occurs between the opposed faces of the belts 21 and 22 as a signature moves through the region between the nip pulleys 24 and 25. As noted below, the belts 21 and 22 perform a second function in section IV of the machine, but the invention in its broader aspects need not employ 90-degree twist belts as the final crimping or folding means. It may be observed, in passing, however, that as the signature leaves the belt 19 and the score wheel 110, it is thereafter held essentially only along the upper edge which constitutes the quarter fold spine (previously the centerline of the half signature), and it proceeds initially with the belts 21 and 22 holding it in a vertical orientation.

As set out more fully below, the belts 19, 20 and signatures carried by them, as well as the belts 21, 22 and signatures carried by them, move at a very high speed S. In one commercial version of the present invention, those belts and the stream of spaced signatures may move at a linear speed S on the order of 2000 feet per minute. The incoming shingle 18 and the velocity $V_1$ of the conveyor belts 15 in the alignment section may be on the order of 300 to 500 feet per minute. Thus, when each individual signature is grabbed by the belt flights 19*a*, 20*a* at the nip between the pulleys 75 and 81 (FIG. 9), it is subjected to extremely high acceleration, and its velocity is increased by a chosen and significant multiple (e.g., by a factor of 4 or more). The grabbing or nipping action at the upstream throat between the belt flights 19*a* and 20*a* does not always exert uniform and perfectly straight forces on the leading edge of the signature being accelerated. Indeed, experience has shown that there is a tendency for some of the individual signatures to be cocked or skewed from a desired position in which (i) their leading edges are at right angles to the flow path and (ii) their longitudinal centerlines proceed into the belt flights 19*a*, 20*a* with coincident or fully aligned relation between those belts. In the event of such cocking or skewing as a signature enters the belts 19 and 20, then the subsequent camming and folding action would produce unsymmetrical or relatively cocked downwardly depending panels in the quarter signature. This problem is overcome, in accordance with one aspect of the present invention, by means for inhibiting the cocking or skewing of a signature as it is grabbed by and accelerated for travel with the belts 19 and 20.

Such means, in one form, are here provided by a device which exerts stabilizing forces on a signature leaving the alignment section II and just as it enters the nip throat between the belts 19, 20 at the pulleys 75, 81. As shown in FIGS. 1, 3, 5 and 6, such means take the form of a narrow vacuum belt 115 disposed in underlying relation to the shingle 18 as it approaches the pulleys 75 and 81. The endless vacuum belt is trained over upstream and downstream pulleys 116 and 118, the latter being driven via a belt 119 from the sheave 16 and a shaft 120. The upper surface of the belt 115 is essentially in vertical registry with the upper surface of the conveyor belts 15 and is thus in contact with the undersurfaces of signatures traveling in the shingle 18. The vacuum belt 115 is formed with a plurality of spaced holes or apertures 115*a* therethrough, such apertures being arranged in a longitudinal row which is adapted to overlie a longitudinal slot 120 in an underlying vacuum shoe or plenum 121. The interior of the plenum 121 is coupled to an appropriate vacuum source (not shown) via a conduit 122 so that as the belt 115 travels over the plenum shoe surface, air is sucked by the vacuum source through the plenum, through the slot 120, and through the holes 115*a*, thereby to attract overlying signatures with reasonable force to the synchronously moving upper surface of the belt 115. In consequence, as a signature's leading edge is just being grabbed by the belt flights 19*a*, 20*a* between the pulleys 75 and 81, its trailing portion is held and stabilized by the vacuum force action so that it does not cock or skew due to the sudden forces imposed on the leading edge by the nipping action. Moreover, the next-trailing signature in the running shingle 18 also has the under-surface of its trailing portion in contact with vacuum holes in the belt 115, so that the rapid acceleration of the first signature does not tend to strip out the second signature. Thus, double stripping of signatures due to the extreme acceleration action is inhibited.

For optimum effects in this regard, the longitudinal spacing between successive holes 115*a* in the belt 15 is relatively small, i.e., on the order of one inch. The longitudinal slot 120 in the vacuum plenum 121 has its downstream end spaced upstream from the nip of the rollers 75, 81 a distance which is less than the length L of one signature. Thus, when the leading edge of a given signature is being nipped and accelerated, its trailing end is still in clutched relation to the surface of the belt 115. The downstream end of the slot 120 in the vacuum plenum 121 extends a sufficient distance upstream from the nip of rollers 75, 81 that the next-succeeding signature in the shingle 18 is also attracted to the belt and therefore inhibited from accelerating forwardly when the underlying signature is stripped away.

4. The Horizontal Re-orientation Section in Detail

Figures 14, 15:
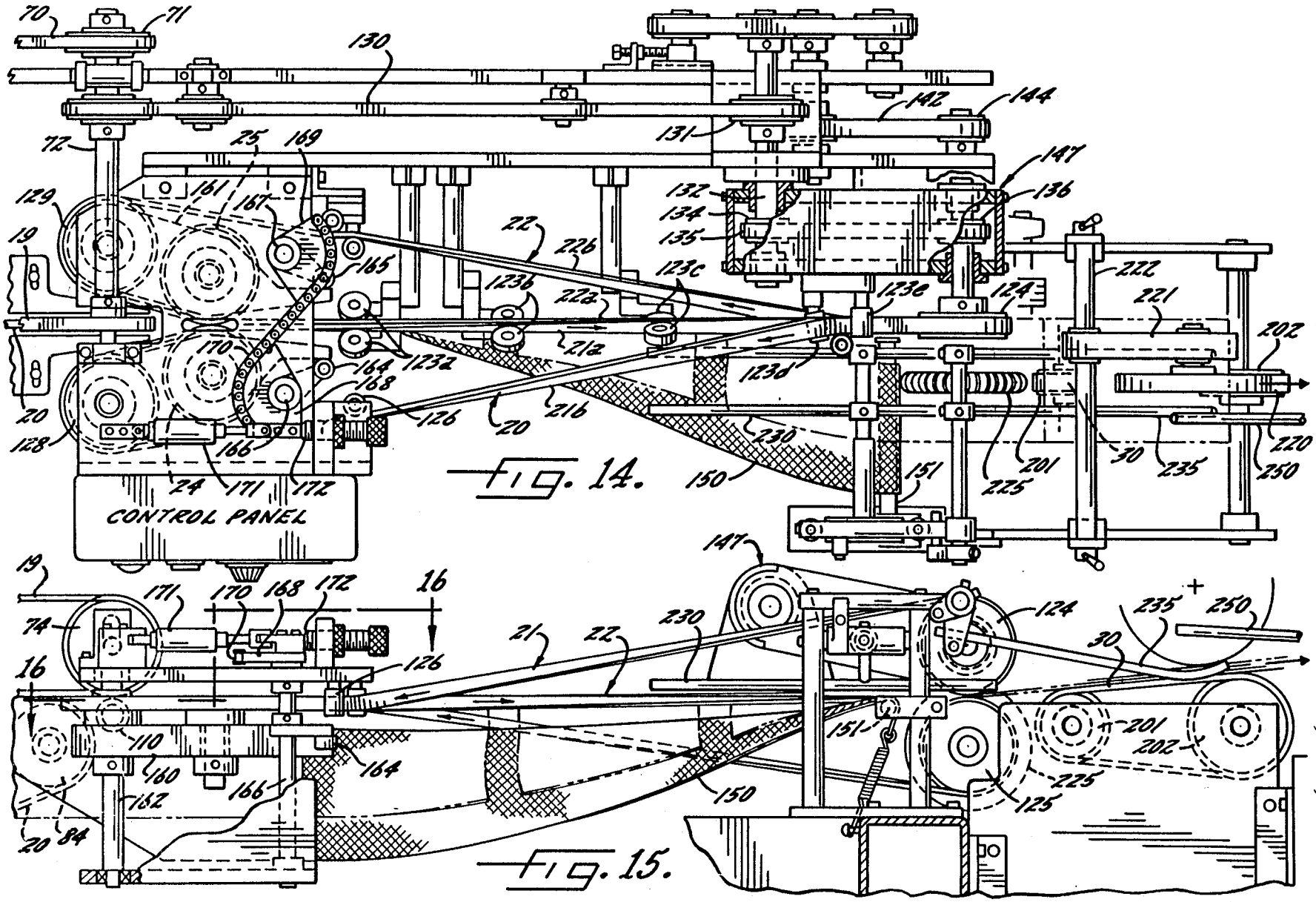
FIG. 14 is a plan view of the horizontal re-orientation or twist section of the machine shown in FIG. 1.
FIG. 15 is a side elevation of the apparatus which appears in FIG. 14.

FIGS. 14 and 15 when taken with FIG. 1 particularly show further details of the preferred apparatus for re-orienting the vertically disposed quarter signatures to a horizontal posture as they continue to be transported in spaced relation relative to one another and at high speed along the flow path. This portion of the machine has previously been denominated section IV in FIG.1.

The belts 21 and 22 may aptly be called "90-degree twist belts". As shown in FIG. 14, the face-to-face flights 21*a*, 22*a* are running downstream, and in the region between the nip rollers 24, 25, the opposed faces of these flights are vertically disposed to receive between them, and to compress, the uppermost spine of a signature leaving the score wheel 110 and the belt 19 beneath the pulley 74. See signature $s_{11}$ in FIG. 8. The belts 21, 22 are trained over and guided between idler pins 123*a*, 123*b*, 123*c*, 123*d* and 120*e* spaced along the flow path and supported by brackets such that each successive pair of idlers has its axes tilted progressively from a vertical to a horizontal orientation. Thus, the flights 21*a*, 22*a* are pressed firmly together to retain their grip on the spine of a quarter fold signature but they progressively twist through 90 degrees to swing that signature counterclockwise (when viewed as looking downstream) about an axis which is essentially coincident with the quarter fold spine. At their downstream ends, the belts 21 and 22 have their opposed faces disposed horizontally, and they run respectively over upper and lower sheaves 124 and 125 (FIG. 15). From these downstream sheaves, the two flights 21*b* and 22*b* of these two belts run generally upstream over idlers 126 to move around upstream sheaves 128 and 129, respectively, which are horizontally disposed and rotatable about vertical axes. The sheaves 128 and 129 are disposed upstream of the nip pulleys 24 and 25 and spaced laterally from the centerline of the flow path so that the belts 21 and 22 as they begin their downstream movement define a tapered throat which leads into the nip or crimping location between the nip rollers 24 and 25. This tapered throat aids in the vertically disposed leading edge of an entering signature being guided into crimping engagement by the belts at the nip location immediately between the nip rollers 24 and 25.

The downstream sheaves 124 and 125 are the elements which impart drive to the twist belts 21 and 22. As shown in FIG. 1, the upper drive sheave 124 is affirmatively rotated by the motor 40 as a driving source and at a speed which makes the linear velocity of the belt 21 equal to the speed S of the belts 19 and 20. More particularly, a belt 130 is trained over a pulley on the shaft 72 and therefore driven from the motor 40 via the belt 42 and the belt 70. The belt 130 leads in a downstream direction to drive a pulley 131 on a shaft 132 carrying a second pulley 134 which drives yet another belt 135 leading to a pulley 136 on a shaft 138 which carries the upper drive sheave 124 (see also FIG. 14). Thus, as viewed in FIG. 1, the sheave 124 is driven in a clockwise direction and the lower flight 21*a* of the belt 21 moves in a downstream direction.

To affirmatively drive the lower sheave 125 and the belt 22, a relay belt 140 is driven from the shaft 132 to drive a pulley pair 141 which is coupled through yet another belt 142 to a sheave 144 on a shaft 145 carrying the lower drive sheave 125. The latter sheave is thus driven in a counterclockwise direction to make the upper flight 22*a* of the belt 22 travel in a downstream direction. The relative sizing of the various pulley and sheave diameters is such that the twist belts 21 and 22 travel at a linear speed S equal to that of the belts 19 and 20. Collectively, the belts 19, 20 taken with the twist belts 21, 22 constitute a single conveyor means which transport signatures in a spaced stream from the entry pulleys 75, 81 to the downstream exit pulleys or sheaves 124 and 125.

The drive train to the upper belt 22 via its downstream pulley 124 is advantageously arranged so that the uppermost components may be "opened up" for servicing or removal of jammed signatures. This is achieved by mounting the pulleys 136 and 124 on a short shaft which is journaled in the side plates of a box-like swing arm 147, those plates at their upper end being mounted by bearings on the rotating shaft 132 which carries the pulley 134, belt 135, pulley 136 and pulley 124, —the entire swing arm may be pivoted upwardly about the axis of the shaft 132 (to the phantom position represented diagrammatically in FIG. 20), thereby lifting the pulley 24 and the downstream portion of the belt 21 away from the belt 22 and its drive pulley 125. When the arm 147 is so raised, any crumpled signatures created by an unexpected jam may be easily removed. Indeed, some of the idlers (e.g. 120*e*) may be carried on the swing arm 147 and thus lift a considerable portion of the belt 21 when the arm is rocked upwardly. The arm 147 may, if desired, be locked in its downwardly inclined, normal position, but it may be sufficient for it to reside in the lower position merely under the influence of gravity as determined by an adjustable stop (visible in FIG. 1) which rests against a frame member.

As each signature enters between the vertically opposed belts 19 and 20, it is in a horizontal orientation and gripped along a narrow region at its transverse centerline. That signature traveling with the belts 19 and 20 is then subjected to a given operation as an incident to its travel, such operation here being the downward camming of the signature wings to form a bight along the top, followed by scoring and nipping along the bight to form a quarter fold. Transport of that quarter folded signature with vertical orientation and at the high speed is continued by the 90-degree twist belts 21, 22 which hold the signature essentially solely along is upper edge or quarter fold. The 90-degree twist belts rock the signature upwardly to a horizontal orientation where it exits from between the upper and lower downstream drive sheaves 124, 125. At this exit point from the 90-degree twist belts, the signature is still being gripped and transported solely by engagement of those belts along the quarter fold spine which is oriented lengthwise along and parallel to the path of travel.

The twist belts are thus called upon to lift essentially the entire signature which lies to the right of the twist belts. Depending upon the weight of each signature, of course, the twist belts must exert a relatively great lifting force on each signature in order to swing the unsupported weight of the signature from the horizontal to the vertical orientation. In accordance with one aspect of the present invention, the lifting force required from the twist belts, and the action of rocking each signature through 90 degrees from the vertical to the horizontal, is assisted by means engageable with the signature laterally outboard from the twist belts. FIGS. 14 and 15 show means forming a twisted surface underlying a signature as it is rocked and which, in part, lift that part of the signature disposed to the right of the twist belts. In the present instance, such means take the form of a fabric web 150 having its upstream edge anchored along a vertical line to a portion of the machine frame just to the right of the vertical quarter signatures as they exit beyond the idlers 120*a*. The downstream edge of the fabric web is by contrast, disposed horizontally and anchored to a horizontal support bar 151. The fabric web 150 thus forms an inclined ramp along which that portion of a signature to the right of the twisted belts rides as it travels downstream and is thereby lifted as it slides along the fabric web or twisted surface as an incident to its travel downstream.

While a fabric web has been shown in FIGS. 14 and 15, it will be understood that the camming or lifting action may be achieved with other, similar arrangements. For example, a stretch-formed sheet of metal might be employed, or a plurality of spaced nylon cords (similar to the cords 100 in FIG. 7) might be utilized. Also, while the twisted surface formed by the web 150 here underlies that portion of a signature disposed to the right of the twisted belts, there may be a tendency due to air dynamics for the traveling signature to flutter or deflect upwardly. Therefore, in a preferred arrangement, a second twisted surface may be provided parallel to and spaced above the first surface provided by the web 150 thereby to define a twisted corridor which confines the signature portion to the right of the twisted belts so that it must progressively change its orientation from the vertical to the horizontal.

As indicated above, the horizontally disposed pulleys 128, 129 upstream of the nipping pulleys 24, 25 make the belts travel in a path which creates a broadly fanned channel that converges to the nip point. The adjustment of the lateral spacing between the nip pulleys 24, 25 (and the spacing between the opposed faces of the flights 21*a*, 22*a* or indeed the pressure at the faces of those resilient belts, if they are normally in contact, as preferred) is of some importance for reliable crimping of the quarter fold. Certainly, fine tuning of that adjustment will be required when the machine is set up for different jobs to process signatures of different thickness, whether due to greater or lesser numbers of pages or paper of greater of lesser caliper. And desirably, one will wish to "open up" the nip gap to clear unexpected jams and then re-close it to the previously-adjusted setting to avoid tedious delays.

Although specifically different arrangements may be chosen, those objectives of adjustability and reclosure to a previously adjusted setting are here realized by the mechanism shown particularly in FIGS. 14–17. The nip pulleys 24, 25 are journaled on the downstream mid-regions of two rocker plates 160, 161 carried on the vertical shafts 162 mounted in the frame on which the pulleys 128, 129 are journaled. The rocker plates lie beneath the pulleys 128, 129 and have freedom to swing in a horizontal plane about the vertical axes of the shafts 162. The belts 21, 22 in this instance are resilient and stretched with considerable tension on their path-defining pulleys. Thus, the belts act as a biasing means pushing the nip pulleys laterally away from the flow path and urging the rocker arms 160 and 161 respectively c.w. and c.c.w. about the shafts 162. The positions of the rocker arms are determined, however, by their downstream tips engaging stop rollers 164, 165 on stop arms fixed to vertical pivot shafts 166, 167. Fixed to the upper ends of such shafts are toothed sprocket segments 168, 169 over which a tensile element or chain 170 is trained in opposite sense. That is, as viewed in FIGS. 16 and 17, when the chain 170 is pulled at its end on the right side of the flow path, the segment 168 turns c.c.w. to move the stop roller 164 inboard; while the segment 169 turns c.w. to move the stop roller equally inboard. The stop rollers in turn swing the rocker arms 160, 161 respectively c.w. and c.c.w. against the biasing action of the belts 21, 22.

The operation of the chain 170 is determined by a pneumatic actuator 171 (cylinder and piston) which extends when compressed air from any suitable source (not shown) is applied. The left end of the actuator is anchored by a pivot and its right end is pivotally connected to the lower rim of the segment 168. When air pressure is applied, therefore, the segment 168 is rocked c.c.w. against an adjustable stop screw 172 and the nip gap is closed (FIG. 16) to a width determined by the setting of that screw. When air pressure is removed, the biasing action of the belts 21, 22 pulls the nip pulleys 24, 25 apart by swinging the rocker plates 160, 161 about shafts 162, the tension in the chain being absent and the segments 168, 169 with the stop rollers 164, 165 being able to retreat in c.c.w. and c.w. directions, respectively.

One need only adjust the stop screw 172 to establish the nip gap (between pulleys 24, 25) and the degree of compression between the pressed faces of the belt flights 21*a*, 22*a* in the gap —to achieve the required nipping action for the thickness of signatures being handled during processing of any given job. To run, air is applied to the actuator 171 and the gap is closed (FIG. 16). If a jam occurs midway through the job, the air is simply turned off and the gap opens (FIG. 17) for clearance. By turning the air back on, the gap recloses to the same setting previously established when the stop screw was adjusted.

In summary, quarter folded signatures are brought by the re-orientation belts 21, 22 in spaced succession and at the high speed S to an exit point which is defined by the opposed regions of the downstream pulleys 124 and 125. Each signature is still being carried and transported by the grip of those belts along its left edge (which is the quarter fold spine of that signature), although the right portion of the signature is partially and lightly supported by the underlying and essentially horizontal surface of the fabric web 150.

5. The Slow-Down and Re-Shinglinq Section in Detail

It is highly desirable to greatly reduce the speed with which the quarter folded signatures are traveling, simply for the reasons that conveyors operating at such speeds are more apt to wear or become mis-adjusted and the signatures themselves are subjected to possible impact damage or flutter displacement unless their velocity is reduced. As a more practical reason, subsequent processing apparatus for acting upon the quarter-folded signatures is generally designed to accept signatures in a running shingle, and a given throughput in terms of signatures per hour may be more easily obtained with signatures handled in a shingle as contrasted to signatures in a separated running stream.

In accordance with an important feature of the invention, means are provided not only to slow down or decelerate the signatures leaving the high-speed conveying belts 21, 22 but also to convert them into a rather slowly running shingle with a relatively small or determinable setback. Such means are made up of a plurality of physical elements which, at first glance, seem to have little physical relationship, but which have been found to have a high degree of functional cooperation with one another to achieve the desired end result.

In particular, the decelerating and re-shingling means is constituted by a moving throat into which each successive signature is ejected from the high speed stream conveying means, e.g., ejected from the belts 21, 22 at the exit pulleys 124, 125. The lower half of that moving throat is constituted by a driven conveyor belt 30 (i) moving at the desired velocity $V_2$ for the output shingle and (ii) disposed closely downstream from the ejection point at the pulleys 124, 125. See FIGS. 1, 15 19 and 20. This output conveyor belt 30 is laterally offset from the ejection pulleys 124, 125 so as to lie essentially under the lateral centerline of signatures propelled forwardly due to the driving engagement of the belts 21, 22 with their right edges. The belt 30 is, moreover, trained over upstream and downstream pulleys 201 and 202, the latter being of larger diameter so that the upper flight of the belt is inclined upwardly from the horizontal at a desired angle, e.g., about 15 degrees. To drive the shingle-forming belt 30, motion is transferred from the shaft 145 (FIG. 1) through belts 205 to a multiple-groove "cone-shaped" sheave 206, thence through a belt 208 to a complementary cone-shaped sheave 209 disposed on a shaft 210. A pulley on that latter shaft carries drive belts 211 to a pulley 212 on the shaft 214 which carries the downstream pulley 202 that drives the belt 30. It will be seen, therefore, that when the belt 208 is relocated in different aligned grooves of the cone-shaped sheaves 206, 209, then the drive ratio between the speed of the shaft 145 and the speed of the belt 30 is adjusted or changed. As noted below, the linear velocity $V_2$ of the shingle-transporting belt 30 is made a predetermined fraction of the speed S with which the belts 21, 22 move and with which signatures are ejected from the pulleys 124, 125.

Figures 18, 19, 21:
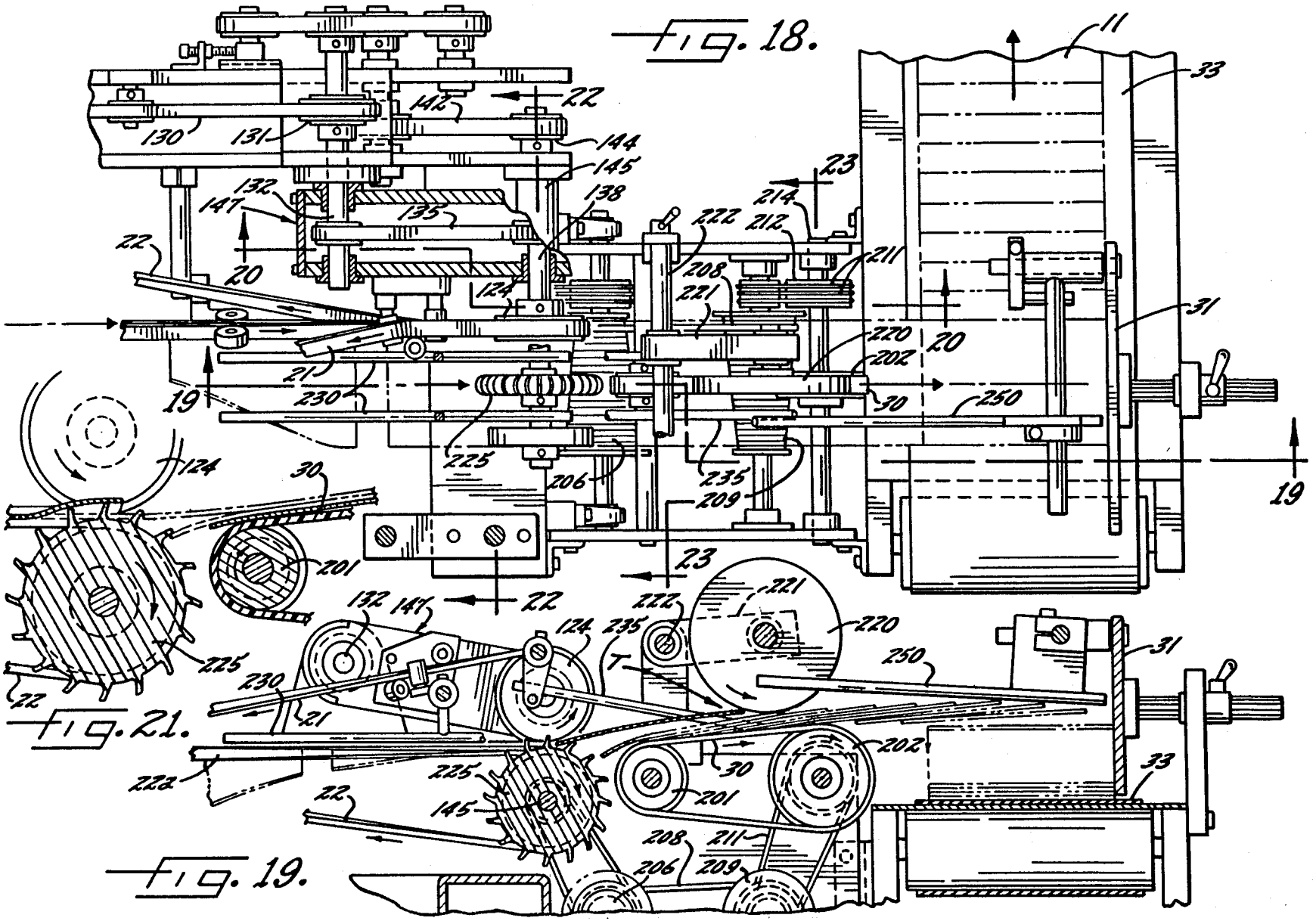
FIG. 18 is a plan view of the slow-down and re-shingle portion of the machine illustrated in FIG. 1.
FIGS. 19 and 20 are vertical sections taken substantially along the offset lines 19—19 and 20—20 in FIG. 18.
FIG. 21 is a fragmentary, enlarged view corresponding to a portion of FIG. 19.
Figure 20:
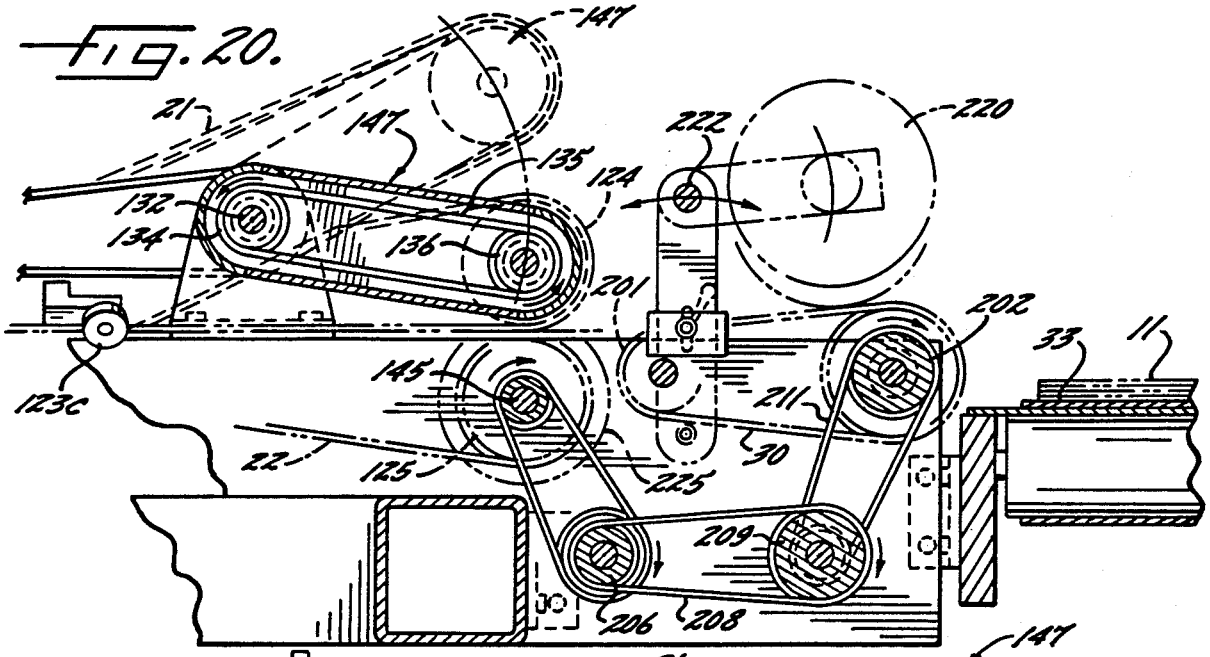

The second and upper part of the moving throat is provided by a moving barrier surface disposed to intercept the leading edges of signatures ejected with flyout action from the exit pulleys 124, 125. The moving barrier surface is here constituted by the arcuate periphery of a decelerating wheel 220 disposed above and in spaced relation to the belt 30 so as to define an inclined throat T (FIG. 19). The wheel 220 is journaled on a stub shaft carried by an arm 221 pivotally mounted on and projecting in a downstream direction from a transverse support rod 222. The support rod is adjustable in its upstream/downstream position on the frame of the machine and it overlies with considerable elevation the belt 30. The arm 221 has freedom to rock about the rod 222, and the wheel 220 is biased downwardly toward the belt 30 simply by the influence of its own weight. The wheel 220 is continuously rotated c.c.w. simply because its lowest peripheral point is in contact with the belt 30 moving downstream or more accurately, with signatures in a shingle moving downstream with that belt.

As shown generally in FIG. 19, the upstream/downstream position of the deceleration wheel 220 is adjusted such that a signature whose trailing edge is just leaving the belt nip between the exit pulleys 124, 125 has its leading edge just engaging or striking the periphery of the deceleration wheel slightly above the belt 30 and slightly above any signatures previously deposited on and then running with that belt. In consequence, as the signature "flies out" from the belt nip along its left edge at the exit pulleys 124, 125 its leading edge (in the medial or centerline region) strikes the downwardly inclined, downwardly moving barrier surface constituted by the periphery of the wheel 220. That leading edge is thus cammed and urged downwardly onto the top of the preceding signature then moving with the belt 30.

With the signature traveling at a very high speed S, its leading edge, in the transverse middle portion, strikes the periphery of the deceleration wheel 220 and somewhat slides relative thereto forwardly and downwardly along that peripheral surface. This striking and sliding action is believed to convert some of the signature's kinetic energy into heat. Moreover, it has been observed in a physical machine embodiment as here illustrated that when the leading edge of a "flying-out" signature strikes the periphery of the deceleration wheel 220, the wheel is actually incremented or "skidded" in its counterclockwise rotation. This ratcheting forward in the rotation of the wheel 220 causes it to skid or slide on the underlying signature which is resting on and moving with the belt 30. Skidding of the wheel relative to the underlying signature is believed to dissipate kinetic energy in the form of heat. Although this theory of operation is not certain, the physical apparatus has been found to operate successfully. The theory is applicant's best present understanding as to why the operation is so successful in quickly and effectively decelerating a signature flying out at high velocity to a signature which moves at the lower velocity of the belt 30 after it falls down on top of the shingle thus formed.

As a second but important factor in the deceleration and re-shingling section of the machine, a tail knock-down wheel 225 is disposed on the shaft 145 so as to be driven rotationally in unison with the pulley 125 which drives the belt 22. The knock-down wheel 225 is, however, laterally offset to the right of the pulleys 124 and 125 (see FIG. 14) so that it underlies the centerline of a signature whose left edge is gripped between the belts 21, 22 as that signature passes between the pulleys 124 and 125. As will be apparent from FIGS. 14 and 18, the knock-down wheel 225 is larger in diameter than the pulleys 124, 125. Thus, the peripheral surface speed of that wheel is greater than the speed with which the overlying signature is moving. The periphery of the knock-down wheel simply rubs forwardly relative to the bottom surface of that signature which is still being carried between the belts 21 and 22.

Figure 22:
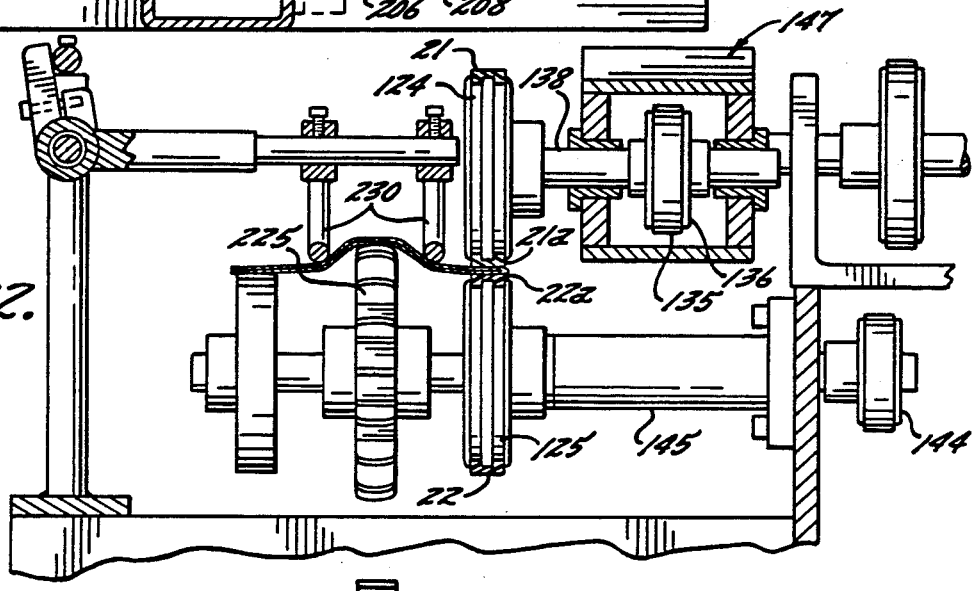
FIGS. 22 and 23 are transverse vertical section views taken substantially along the offset lines 22—22 and 23—23, respectively, in FIG. 18 to show certain details of the machine's slow-down and re-shingle section.

The knock-down wheel 225 is milled or otherwise formed to have peripherally spaced teeth which are, in effect, inclined slightly in a forward direction as the wheel rotates clockwise (FIG. 19) and which are somewhat rounded in an axial direction as viewed in FIG. 22. As will be explained below, the knock-down wheel serves as a means to tuck the trailing edges of signatures down onto the shingle being formed on the upper surface of the belt 30; for the moment, however, it may be noted that the knock-down wheel 225 is straddled transversely by two stationary rods 230 having their lowest surfaces disposed below the upper perihery of the wheel 225. The wheel 225 (which extends upwardly beyond the plane of the nip between exit pulleys 124, 125) together with the rods 230 form means to create a longitudinal, upward bowing (see FIG. 22) in the medial region of a passing signature. As the signature is carried forwardly in the grip of the belts 21, 22 between the pulleys 124, 125 (FIG. 22), that signature is "ribbed" substantially along its centerline. Such bowing stiffens the signature to inhibit drooping of its leading edge portion as it extends forwardly and "flies out" from the grip between the pulleys 124 and 125. This assures that the leading edge of such a flying signature is elevated above signatures previously deposited on the belt 30. Indeed, the leading edges of the signatures at their centerline regions strike the periphery of the deceleration wheel 220 at a point elevated above the belt 30 and above the preceding signature then resting on the belt—, the bowing action of the knock-down wheel 225 and its cooperating rods 230 aiding in this action.

Figure 23:
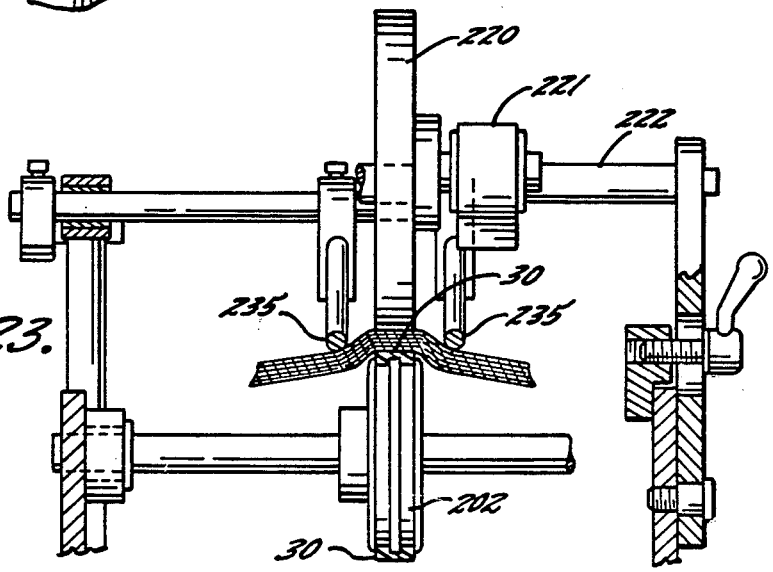

Moreover, just as the leading edges of the "flying out" signatures approach the surface of the deceleration wheel 220, the regions of the leading edge laterally spaced from the centerline engage downwardly inclined plow rods 235 (FIGS. 15 and 23). At the downstream location just where the wheel 220 would (except for intervening signatures) touch the belt 30, the bottom surfaces of the plow rods 235 are lower than the belt surface. By the time a signature reaches that point, it is bent downwardly on opposite sides of the belt (FIG. 23) and longitudinally ribbed and stiffened to fly out from the pulley 202. But the rods also contact the leading edge of a signature before such leading edge reaches that point, thereby to aid in making the centerline region of the leading edge strike the surface of the deceleration wheel 220 at a point elevated above signatures previously deposited on and moving with the belt 30.

Finally, as seen in FIG. 21, the upstream pulley 201 for the belt 30 is only spaced slightly forwardly (in a downstream direction) from the knock-down wheel 225. As a given signature reaches that point where its leading edge has struck the surface of the deceleration wheel 220 and skidded downwardly to lie on the preceding signature, the tail of that given signature is caught by the forwardly-moving and forwardly-inclined next tooth of the knock-down wheel, so that the trailing edge is "knocked down" and prevented from curling up. When the signature is pulled fowardly as its leading edge slides between the wheel 220 and the belt 30, that trailing edge is pulled away from engagement with the knock-down tooth. Thus, when a signature "flies out" (and even though the fly-out distance with no support is very short) its trailing edge or tail is caught and tucked down so that the signature must overlie the preceding signatures on the belt 30 and move forwardly in shingled relation to those preceding signatures. Because the signatures are carried in a spaced stream by the belts 21, 22 (they are spaced apart, for example, about eight inches), they are ejected at the speed S at successively later instants in time (e.g., one every 50 milliseconds). The belt 30 moves a short distance, and less than the length L of one signature, between those instants. Thus, the ejected signatures are decelerated and must fall upon one are other in staggered relation to form the shingle 34 which then moves with and at the velocity $V_2$ of the belt.

In summary, there are several separate functional actions all contributing to deceleration of separated high velocity signatures and their re-formation into a signature running at a much lower velocity. First, a moving throat of decreasing width is formed by the lower moving surface (slightly inclined) of the belt 30 and an upper moving surface of the overlying deceleration wheel 200 which is biased downwardly by its own weight and rotated counterclockwise as a consequence of engagement with the underlying signatures moving forward as a shingle with the belt 30. As the leading edge of each signature strikes the periphery of the deceleration wheel 220, it slides somewhat relative to or along the surface of that wheel and energy is dissipated to slow the signature down. Moveover, as the leading edge of a signature strikes the periphery of the wheel 220, the latter rotationally increments in a counterclockwise direction and skids at its point of engagement with an underlying signature interposed between it and the belt 30. This also is believed to dissipate some kinetic energy as heat. The signature which is exiting from between the pulleys 124, 125 is stiffened against droop of its unsupported leading edge portion by the lengthwise bow created in that signature through the coaction of the rods 230 (FIG. 22) pressing the signature downwardly on opposite lateral sides of the knock-down wheel 225. The signature flying out will have its lateral portions also slidingly engage the tapered plow rods 235, and these latter plow rods impose a lengthwise bow in the running shingle as it departs from the belt 30 in the region of the downstream pulley 202. Just as the trailing edge of a "flying out" signature leaves the nip of the belts between the pulleys 124, 125, that trailing edge is caught by the teeth of the rotating knock-down wheel and it is thus held back and tucked down (FIG. 21). The leading edge is, of course, "tucked down" by the downwardly curved and downwardly moving peripheral surface of the deceleration wheel 220. As a result of all these actions, signatures exiting in a serially spaced stream at a speed S from the belts 21, 22 at the exit pulleys 124, 125 are decelerated so that they are deposited in staggered or set back relation on the conveyor belt 30 moving at a much lower velocity $V_2$, the signatures thus being deposited in the form of a shingle running at the velocity $V_2$ and with an essentially uniform setback $SSB_2$.

6. The Bump-and-Turn Section in Detail

As stated previously, the bump and turn section VI of the machine illustrated in FIG. 1 is a known device for converting a first running shingle into a second running shingle, one lateral edge of signatures in the first shingle becoming the leading edge in the second shingle. As here shown in FIGS. 18 and 19, signatures in the shingle 34 moving at the velocity $V_2$ are simply ejected from the belt 30 such that their leading edges successively strike a bump plate 31 to make each signature successively and in time-spaced relation fall downwardly onto a conveyor 33 running at right angles to the original direction. As the shingle 34 exits from the belt 30, it is moving in a slightly upwardly inclined (about 15 degrees) direction. To assure that each of the signatures in that shingle 34 strikes the bump plate 230 reliably, the bowing plows 235 described above and shown in FIG. 23 impart a centerline rib to the traveling shingle so that the individual signatures are somewhat stiffened and do not droop as their leading edges project beyond the departure point at the top of the pulley 202. Moreover, a downwardly inclined rod 250 is mounted above the signature 34 at its exiting location. This intercepts the leading edges of those signatures to cam them downwardly and assure that they strike the bump plate reliably and in succession. Therefore, it will be understood that the exit shingle 34 from the present machine leaving the belt 30 at the velocity $V_2$ may be converted, in known fashion, to a shingle 11 running at right angles with the conveyor 33 and with the quarter fold spines as the leading edges. Such spines previously were disposed to be the left lateral edges in the separated stream carried by the belts 21 and 22 and the left lateral edges of the shingle 34 formed on the belt 30.

7. Speed, Spacing and Rate Relationships

It may now be seen that the present invention enables signatures to be received in an incoming shingle 18 at first velocity $V_1$. In section III, it accelerates the signatures to make a stream of spaced, individual shingles traveling at a very greatly higher speed S so that a given operation (here, quarter folding) can and is performed on each signature in succession. Then that high speed stream is changed into an exiting shingle 34 traveling at a velocity $V_2$ greatly reduced from the speed S.

The present invention contemplates certain relationships which avoid running dry (starving) in the deceleration and re-shingling section V (which would create untenable gaps or discontinuities in the second shingle 34), which avoid piling up in the section V (which would create jams and untenable stoppages to clear them), and yet which permits the velocities $V_1$ and $V_2$,and the setbacks $SSB_1$ and $SSB_2$, for the input and output shingles 18 and 34 (FIG. 2) to be matched to the characteristics of any source (which feeds in the shingle 18) or of any subsequent device (which receives and acts upon the output shingle 34).

Although it is perhaps more conventional to speak of through-put rates in units of signatures per hour, the rate will here be considered as signatures per minute, simply to facilitate the following description.

It may be seen that the through-put rate SPM of signatures in a moving shingle depends upon both the velocity of conveyance and the shingle setback, that is $$SPM = \frac{V}{SSB} \tag{1}$$

where V is velocity in feet per minute (f.p.m.) and SSB is the setback in feet (inches/12).

To achieve the desired objective of avoiding running dry and pile-up in the output shingle 34, the nominal or average through-put rates must be generally equal at the input end and the output end. Thus, one needs to make $$SPM_1 = SPM_2 \tag{2}$$

This leads to the relation $$\frac{V_1}{SSB_1} = \frac{V_2}{SSB_2}\ ;\ \frac{V_1}{V_2} = \frac{SSB_1}{SSB_2} \tag{3}$$

where input and output velocities, and the two setbacks are as labeled in FIG. 2.

To form a stream of shingles spaced apart and traveling at a higher speed S, the acceleration section II will increase the velocity by some chosen multiple $K_1$ (which need not be an integer) such that $$S = K_1 V_1 \tag{4}$$

But once that high speed stream has been created, then the signatures must be slowed down by a certain fraction $1/K_2$ to obtain a shingle traveling at the velocity $V_2$. This leads to the expression $$V_2 = \frac{1}{K_2} \cdot S \tag{5}$$

Combining (4) and (5) yields $$\frac{V_1}{V_2} = \frac{K_2}{K_1} \tag{6}$$

where $K_1$ and $1/K_2$ are a multiple and a fraction which may be chosen (and obtained respectively by adjusting the gear box 44 and re-setting the connecting drive belt 208 between the cone sheaves 206, 209 in FIG. 1). The speed S may be chosen and determined by adjusting the speed of the common drive motor 40.

The setback $SSB_1$ is generally fixed by the source (section I) which feeds in the shingle 11 which, after alinement, becomes the shingle 18. But the present invention permits a user to make the output shingle setback $SSB_2$ not necessarily equal to $SSB_1$, but indeed unequal and of essentially any desired value, while still eliminating running dry or pile-up.

By substitution from Eq. (3) into Eq. (6), one obtains $$\frac{K_2}{K_1} = \frac{SSB_1}{SSB_2} \tag{7}$$

$$SSB_2 = \frac{K_1}{K_2} \cdot SSB_1$$

Thus, given the incoming setback $SSB_1$, one may choose the values and the ratio of $K_1$ and $K_2$ to avoid both running dry and pile-up.

In a typical application of the invention and as an example, the source (e.g., an infeeder or printing press) might supply signatures of length L equal to 12" in the shingle 10 running at a velocity of 500 f.p.m. and with a setback of 5", the rate thus being $$SPM = \frac{V}{SSB} = \frac{500}{5/12} = 1200 \text{ sig./min} \quad (8)$$

that is, 72,000 signatures per hour. Choosing a speed up multiple of $K_1 = 4$, the speed S for the belts 19, 20 and 21, 22 would be set by adjusting motor 40) to $$S = K_1 V_1 = 4 \times 500 = 2000 \text{ f.p.m.} \quad (9)$$

and by adjusting the ratio of the gear unit 44, the velocity $V_1$ of the belts 15 and the shingle 18 would be set to 500 f.p.m. to match the shingle 10.

Neglecting the time delay of imperfect acceleration (which will reduce the separation spacing SP slightly), the spacing SP between the individual signatures in the stream (see FIG. 2) will be $$SP = K_1 . SSB_1 - L = 4 \times 5 = 8 \text{ inches} \quad (10)$$

as they travel at 2000 f.p.m. The camming action for quarter folding at this (or even higher) speed has been found successful and reliable.

Now, assume that it is desired to create a relatively tight output shingle with a setback $SSB_2$ of about 2". To achieve this, one will know from Eq. (3) that the exit velocity $V_2$ for the conveyor belt 200 should be made $$V_2 = V_1 \cdot \frac{SSB_2}{SSB_1} = 500 \times \frac{2}{5} = 200 \text{ f.p.m.} \quad (11)$$

Since the speed S is 2000 f.p.m., the belt connection between the cone sheaves 206, 209 would be adjusted to provide a 10:1 speed reduction, i.e., such that from Eq. (5)

$$K_2 = \frac{S}{V_2} = \frac{2000}{200} = 10 \quad (12)$$

In this fashion, the nominally maintained and desired setback $SSB_2$ of 2 inches may be obtained.

Of course, that setback value may be increased or decreased by making $K_2/K_1$ take on some ratio other than 10/4 and then changing the speed S to match $V_1$ to the velocity of the source shingle.

The present invention brings to the art a breakthrough in the speed of quarter folders. It will enable quarter folding of signatures of 10" to 15" length at a through-put rate of 72,000 or even 80,000 signatures per hour (compared to 30,000 or 35,000 by the best known prior art). It accepts signatures as a shingled input and provides the quarter signatures in a shingled output which need travel at only moderate velocities. Importantly and in a generic sense, it enables the tightness of setback of the output shingle after any given operation, which must be performed on individual signatures, to be determined as a matter of choice.

I claim:

1. In a signature manipulating device for swinging individual traveling signatures from orientation in a vertical plane to orientation in a horizontal plane, the combination comprising (a) a pair of driven twist belts running in one flight area essentially in face-to-face relation with their faces substantially in said vertical plane, (b) guide means for causing said face-to-face portions of said belts to twist their faces from said vertical plane to said horizontal plane as they travel to an exit point, (c) means for feeding individual, vertically-oriented signatures seriatim into gripped engagement between and for transport by the opposed faces of said belts from said one flight area to said exit point, and (d) means forming a twisted surface having (i) its upstream end at said one flight area and lying essentially in a vertical plane, and (ii) its downstream end at said exit point and lying essentially in a horizontal plane beneath a portion of a passing signature which is unsupported by said belts, whereby said means (d) function as a camming means acting on passing signatures to aid said belts in swinging said signatures from said vertical to said horizontal orientation.

2. The combination set forth by claim 1 further characterized in that said feeding means feed the uppermost spine regions of successive signatures into gripped engagement between the opposed faces of said belts and each signature is carried essentially by a grip along its spine edge.

3. The combination set forth by claim 1 further including means forming a second twisted surface shaped similarly to and spaced above that formed by said means (d), the two twisted surfaces forming a twisted corridor.

4. In a document manipulating device for swinging traveling documents from orientation in one plane (e.g. vertical) to orientation in a different plane (e.g. horizontal), the combination comprising (a) a pair of driven twist belts running in one flight area essentially in face-to-face relation with their faces substantially in said one plane, (b) guide means for causing said belts to twist their faces from said one plane to said different plane as they travel from said one flight area to an exit point, (c) means for feeding documents which are oriented substantially in said one plane into gripped engagement between and for transport by the opposed faces of said belts from said one flight area to said exit point, and (d) means forming a twisted surface having (i) its upstream end at said one flight area and lying parallel to and closely spaced from said one plane, and (ii) its downstream end closer to said exit point and lying parallel to and closely spaced from said different plane, whereby said means (d) function as a camming means acting on passing documents to aid said belts in swinging the documents from said one plane to said different plane as they are being transported by the belts.

5. The combination set forth in claim 4 further characterized in that said means (c) for feeding documents are arranged to feed one lengthwise edge of the documents into gripped engagement between the opposed faces of said belts in said one flight area, each document being carried essentially by a grip along that one edge, and said twisted surface is engaged at its portions laterally disposed from said one edge.

6. The combination set forth in claim 4 further including (e) means forming a second twisted surface shaped similarly to and spaced from that formed by said means (d), the two twisted surfaces forming a twisted corridor through which portions of documents, which are being transported by said belts, travel.

7. The combination set forth in claim 4 further characterized in that said means (d) is constituted by a plurality of spaced string-like elements under tension.

8. The combination set forth in claim 6 further characterized in that said means (d) and said means (e) are each constituted by a plurality of spaced string-like elements under tension.

* * * * *